US008456413B2

(12) United States Patent
Furukawa et al.

(10) Patent No.: US 8,456,413 B2
(45) Date of Patent: Jun. 4, 2013

(54) DISPLAY DEVICE, DRIVE METHOD THEREFOR, AND ELECTRONIC APPARATUS

(75) Inventors: Norimasa Furukawa, Tokyo (JP); Mitsuyasu Asano, Tokyo (JP); Tomohiro Nishi, Tokyo (JP)

(73) Assignee: Sony Corporation (JP)

( * ) Notice: Subject to any disclaimer, the term of this patent is extended or adjusted under 35 U.S.C. 154(b) by 386 days.

(21) Appl. No.: 12/454,131

(22) Filed: May 13, 2009

(65) Prior Publication Data

US 2009/0295839 A1 Dec. 3, 2009

(30) Foreign Application Priority Data

May 20, 2008 (JP) ..... P2008-131665

(51) Int. Cl.
*G09G 3/36* (2006.01)

(52) U.S. Cl.
USPC ..... 345/102; 345/88

(58) Field of Classification Search
USPC ..... 345/102, 88
See application file for complete search history.

(56) References Cited

U.S. PATENT DOCUMENTS

| | | | | |
|---|---|---|---|---|
| 7,365,729 | B2 * | 4/2008 | Hong | 345/102 |
| 2002/0113764 | A1 * | 8/2002 | Yamada et al. | 345/88 |
| 2008/0068317 | A1 * | 3/2008 | Araki et al. | 345/88 |
| 2008/0258997 | A1 * | 10/2008 | Arai | 345/6 |
| 2008/0284719 | A1 * | 11/2008 | Yoshida | 345/102 |
| 2009/0115719 | A1 * | 5/2009 | Lin et al. | 345/102 |

FOREIGN PATENT DOCUMENTS

| | | |
|---|---|---|
| JP | 2002-318564 | 10/2002 |
| JP | 2003-248462 | 9/2003 |
| JP | 2008-020758 | 1/2008 |

* cited by examiner

*Primary Examiner* — Alexander S Beck
*Assistant Examiner* — Nguyen H Truong
(74) *Attorney, Agent, or Firm* — Lerner, David, Littenberg, Krumholz & Mentlik, LLP

(57) ABSTRACT

A display device includes: a light source section having multiple light sources to emit light in illumination colors including three primary colors of light; a display section for displaying an image in monochrome color by modulating the light emitted from the light source section; and a display control section for driving the light source section and the display section in a field sequential system. The display control section includes a determining section for determining a degree of white or a degree of complementary color of the light sources on the basis of an amount of lighting of each of the illumination colors of the light sources, a setting section for setting white components or complementary-color components of a color determined by a mixing ratio of the illumination colors, and an allocating section for allocating the set white components or the complementary-color components to the fields.

17 Claims, 31 Drawing Sheets

DISPLAY DEVICE, DRIVE METHOD THEREFOR, AND ELECTRONIC APPARATUS

The present application claims priority from Japanese Patent Application No. JP 2008-131665 filed in the Japanese Patent Office on May 20, 2008, the entire content of which is incorporated herein by reference.

BACKGROUND OF THE INVENTION

1. Field of the Invention

The present invention relates to display devices, display methods therefor, and electronic apparatuses. In particular, the present invention relates to a display device, a display method therefor, and a display device which display images by utilizing and modulating light of light sources.

2. Description of the Related Art

Color image display system can be broadly divided into two systems according to an additive color mixing method. A first system is additive color mixing based on a spatial color mixing principle. Specifically, sub-pixels of the three primary colors of light, namely, R (red), G (green), and B (blue), are arranged in a plane at a high density, and the individual color lights are made indiscriminable taking advantage of the spatial resolution of the human eye and are mixed to provide a color image. This first system is employed by a majority of currently commercially available systems, such as CRT (cathode ray tube) systems, and PDP (plasma display panel) systems, and liquid crystal systems.

When the first system is used to configure a display device of a type that displays images by modulating light from light sources (a backlight), for example, a display device that uses non-self-luminous elements (typified by, e.g., liquid crystal elements) as modulation elements, some problems arise. Specifically, such a display device typically requires, for a single screen, three drive circuits that drive sub-pixels so as to correspond to R, G, and B colors, respectively. In addition, such a display device typically requires an RGB color filter. Because of the presence of the color filter, light from the light sources is absorbed by the color filters and thus the light utilization efficiency is reduced to one third.

A second system is additive color mixing based on temporal additive color mixing. More specifically, the RGB primary colors of light are divided along a time axis and plain images having the respective primary colors are sequentially displayed over time (i.e., are time-sequentially displayed). The screens are switched at such a speed that the switching thereof is unperceivable taking advantage of the temporal resolution of the human eye, so that color light is made indiscriminable by temporal color mixing based on the eye's integration effect in the time direction, and a color image is displayed through temporal color mixing.

When the second system is used to configure a display device that uses non-self-luminous elements (typified by, for example, liquid crystal elements) as modulation elements, there are advantages as follows. For example, since a state in which color displayed on one screen at the same time is a homogenous color is obtained, it is possible to eliminate a spatial color filter for discriminating, for each pixel, a color to be displayed on the screen.

Further, with respect to a monochrome display screen, light of the light sources is switched to homogenous-color light and individual screens are switched at such a speed that the switching thereof is unperceivable. In synchronization with back-light (based on the eye's integration effect) being switched to, for example, a monochrome color of R, G, and B, the display image is switched in response to an R signal, G signal, and B signal. Thus, the driving can be performed by only one drive circuit.

In addition, since the color screening is switched over time and a color filter can be eliminated, the second system has an advantage of reducing the loss of the amount of light passage, as described above. Thus, nowadays, the second system is mainly utilized as a modulation system for high-luminance high-heat light sources, in which a reduction in the amount of light tends to cause critical thermal loss, for projectors (projection display systems) and so on. The second system also has an advantage of high light-utility efficiency, and thus various studies are under way.

The second system, however, has a significant drawback in terms of vision. Specifically, the basic display principle of the second system is that, as described above, the screens are switched at a speed at which the switching thereof is unperceivable utilizing the temporal resolution of the human eye. However, the RGB images that are sequentially displayed according to the sequence of elapsing time do not mix with each other properly because of complicated factors, such as a limitation in the optic nerves for the eyeball and sensations of image recognition of the human brain. This can cause a display phenomenon called "color breakup (or color breaking)" by which an image in each primary color is seen as an after-image or the like and with which the observer feels very unpleasant, particularly, when a low-purity image such as a white image is displayed or when he or she keeps track of a moving object displayed on the screen.

Various approaches have been proposed to overcome the drawbacks of the second systems described above. For example, there is a drive system for reducing the amount of color breakup by performing sequential color driving without use of a color filter and inserting a white display frame to sequentially apply stimulus to spectral energy on the retina.

For example, Japanese Unexamined Patent Application Publication No. 2008-020758 discloses a technology for reducing the amount of color breakup. In the technology, a field in which white light components are to be mixed in a white-color component period is provided in each field of an RGB field sequential system.

As another example of the related art proposed to prevent color breakup, Japanese Unexamined Patent Application Publication No. 2002-318564 discloses a technology in which white components are extracted and W (achromatic color) fields are additionally inserted into a sequence of fields "RGBRGB . . . " to provide a sequence of four fields "RGBWRGBW . . . ". For example, Japanese Unexamined Patent Application Publication No. 2003-248462 disclose a technology for preventing color break by extracting image information and varying the coordinates of the color origin points of the primary colors (basic colors) to be processed.

SUMMARY OF THE INVENTION

The related art disclosed in Japanese Unexamined Patent Application Publication No. 2008-020758 has a drawback in that, when a display image portion with high color purity exists on a display screen, white light is mixed thereinto to reduce the color purity of the image portion, thus making it difficult to reproduce correct color. When an attempt is made to reduce the amount of color breakup while maintaining the color purity, it is presumed that, for example, the frequency of the sub-fields needs to be increased to 180 Hz or larger.

That is, in order to reduce the amount of color breakup to a visually unperceivable level or less, it is generally necessary to set a pretty high field frequency to increase the number of fields. At least, with the response capability of the currently available liquid crystal panels, even if a drive frequency of 360 Hz can be realized using a high-speed liquid crystal panel, the white field insertion results in a four field (RGBW) cycle and thus the frequency between the same-color fields becomes one fourth, i.e., 90 Hz. With this frequency, it is difficult to sufficiently reduce the amount of color-breakup. A frequency of 360 Hz has been used by some projectors, other than liquid crystal displays, together with DMDs (digital micromirror devices) or the like. With the frequency, however, it is difficult to reduce the amount of color breakup to the visually perceivable level or less.

In the related art disclosed in Japanese Unexamined Patent Application Publication No. 2002-318564, since the frequency between W and W is one fourth of the field frequency, the effect of preventing color breakup is small. When simultaneous lighting in each field is performed as in the related art disclosed in Japanese Unexamined Patent Application Publication No. 2008-020758, the color purity decreases.

In the related art disclosed in Japanese Unexamined Patent Application Publication No. 2003-248462, when a case in which an image portion with high-saturation color (such as the primary color) exists partially on the screen is considered by way of example, the basic color needs to have its original color in order to maintain the color purity of the image portion. Thus, other portions, i.e., monochrome portions, on the screen cause color breakup, since RGB are divided along a time axis.

In order to prevent color breakup without use of a color filter, a variety of techniques for reducing the amount of color breakup by performing various types of processing along the time axis are also being studied, since in-space modulation is considered to be impossible. However, since field-sequential images that are completely separated into R, G, and B have no inter-field relationship in colors therebetween, color breakup occurs under the current situation. Thus, only available methods found effective as measures to prevent color breakup are a method for mixing white while sacrificing color purity and a method for compensating for the low inter-frame correlations by increasing the field frequency, for example, by interposing a white frame with an increased field frequency.

Accordingly, it is desired to provide a display device that is capable of preventing occurrence of color breakup in the field sequential system, a drive method for the display device, and an electronic apparatus including the display device.

According to an embodiment of the present invention, there is provided a display device that has a light source section having multiple light sources arranged in a plane to emit light in illumination colors including three primary colors of light and a display section configured to display an image in monochrome color by modulating the light emitted from the light source section. During driving of the display device in a field sequential system in which the illumination colors of the light sources are switched for respective fields in one frame to perform color display, a degree of white or a degree of complementary color of the light sources is determined on the basis of an amount of lighting of each of the illumination colors of the light sources, the amount of lighting being determined in accordance with a signal of a color image to be displayed; white components or complementary-color components of a color determined by a mixing ratio of the illumination colors are set on the basis of a result of the determination performed in the determining step; and the set white components or the complementary-color components are allocated to the fields.

Rather than expressing all colors with, for example, the three primary colors, the display device having the above-described configuration employs a scheme for allocating the white components or complementary-color components of the color, determined by the mixing ratio of the illumination lights, to the fields. With this arrangement, color combination is performed in a space and the combination of the amounts of illumination (the amounts of lighting) is performed over time. As a result, the inter-field correlation is increased compared to a case in which this scheme is not employed. An increase in the inter-field correlation can prevent occurrence of color breakup in the field sequential system.

According to the present invention, colors are spatially mixed and the amounts of illumination are temporally combined. Thus, even with a field-sequential display configuration without a color filter, it is possible to achieve color display with almost no color breakup.

DESCRIPTION OF THE PREFERRED EMBODIMENTS

Embodiments of the present invention will be described below in detail with reference to the accompanying drawings.

[System Configuration]

Figure 1:
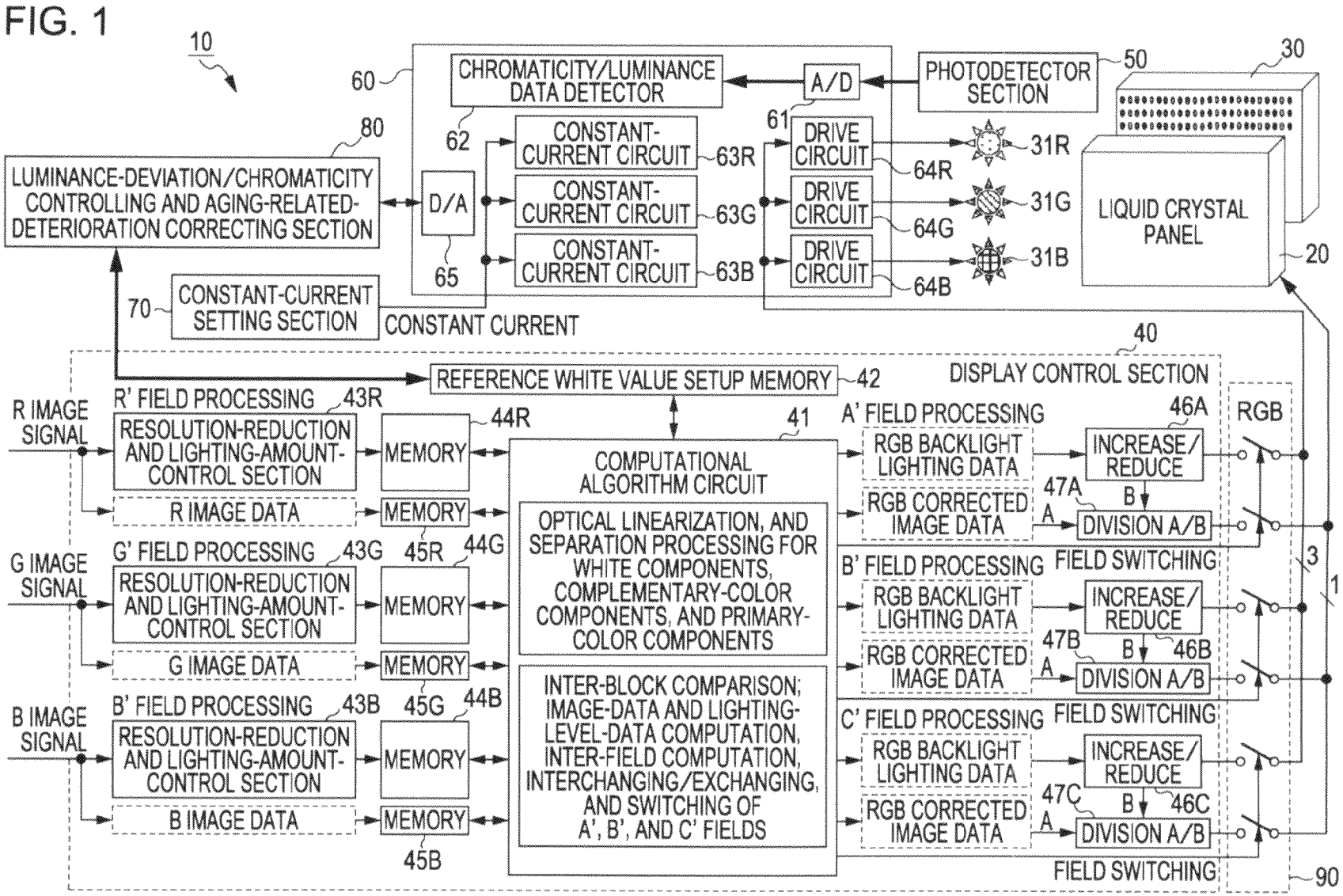
FIG. 1 is a block diagram showing one example of the configuration of a display device according to an embodiment of the present invention.

FIG. 1 is a block diagram showing one example of the configuration of a display device according to an embodiment of the present invention. The display device according to the embodiment of the present invention is directed to a display device of a type that displays images by utilizing and modulating light of a light source. The display device will now be described in conjunction with an example of a liquid-crystal-display device that uses non-self-luminous liquid crystal elements as modulation elements.

As shown in FIG. 1, a liquid crystal display device 10 according to the present embodiment includes a liquid crystal panel 20, a light source section 30, a display control section 40, a photodetector section 50, a light-source drive section 60, a constant-current setting section 70, a luminance-deviation/chromaticity controlling and aging-related-deterioration correcting section 80, and a switch section 90. The liquid crystal panel 20 serves as a display section. The light source section 30 is disposed at a backside of the liquid crystal panel 20 and serves as a so-called "backlight" that illuminates the liquid crystal panel 20. That is, the liquid crystal panel 20 is a light-transmitting panel that displays an image by controlling passage of light, emitted from the light source section 30, by using liquid crystal molecules.

(Liquid Crystal Panel)

Figure 2:
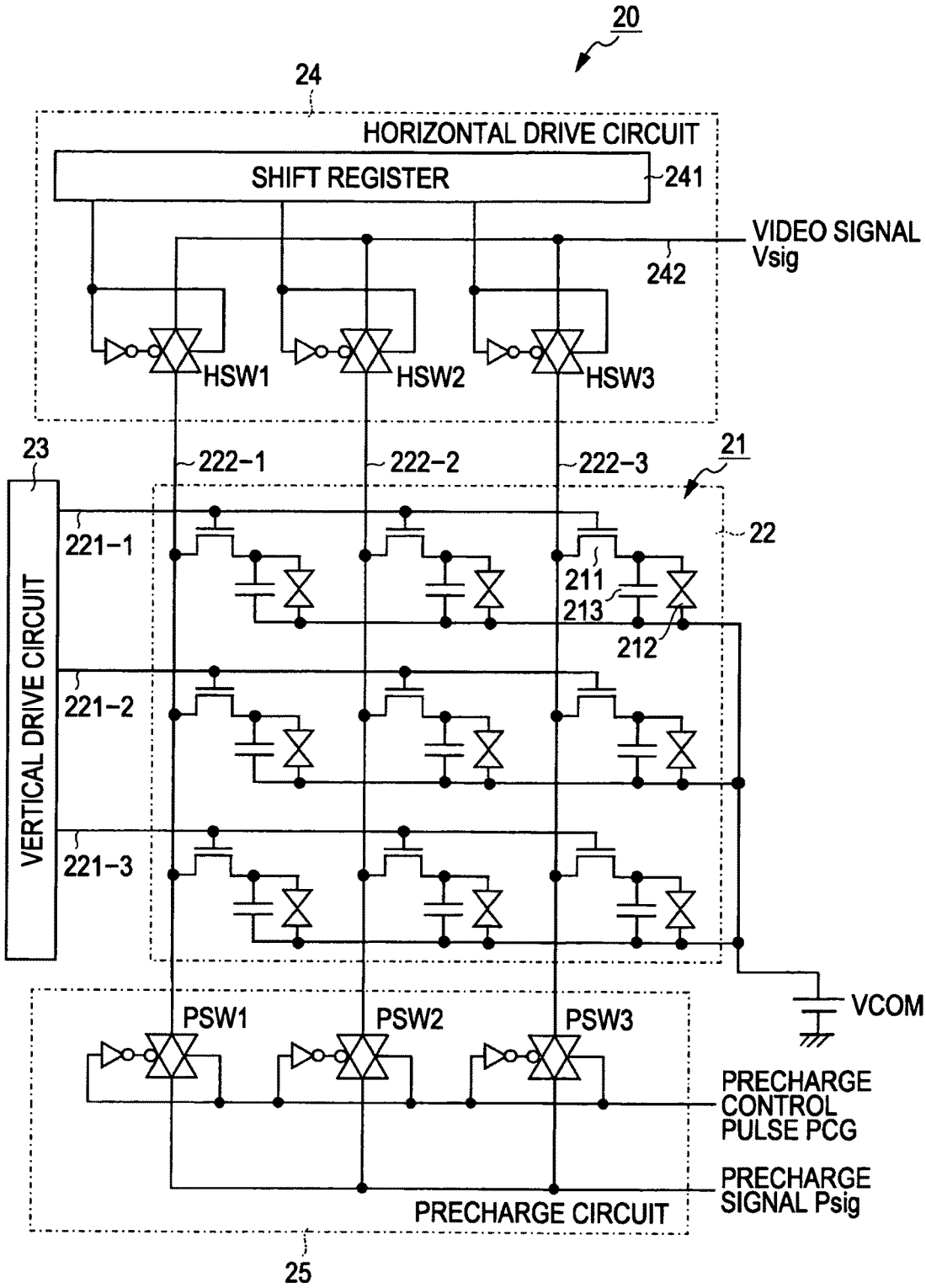
FIG. 2 is a schematic diagram showing one example of the configuration of a liquid crystal panel.

FIG. 2 is a schematic block diagram showing one example of the configuration of the liquid crystal panel 20. As shown in FIG. 2, the liquid crystal panel 20 in this example has a panel structure in which two transparent substrates (not shown) are arranged to oppose each other and liquid crystal material is enclosed between the two substrates to form a liquid crystal layer. The liquid crystal panel 20 includes a pixel array section 22, a vertical drive circuit 23, a horizontal drive circuit 24, and a precharge circuit 25. The pixel array section 22 has pixels 21 that are arranged in a two-dimensional matrix. The liquid crystal panel 20 is a monochrome display panel that has no color filter.

Although the liquid crystal panel 20 has such a panel structure in which the pixel array section 22 and its peripheral drive sections (i.e., the vertical drive circuit 23, the horizontal drive circuit 24, and the precharge circuit 25) are formed on the same substrate, this structure is merely one example. For example, the liquid crystal panel 20 may have a structure in which only the pixel array section 22 is formed on the substrate or may have a structure in which the pixel array section 22 and one or some of the peripheral drive sections are formed on the same substrate.

In the pixel matrix of the pixel array section 22, scan lines 221-1, 221-2, . . . , and so on are arranged in pixel rows and signal lines 222-1, 222-2, . . . , and so on are arranged in pixel columns. In other words, the pixels 21 are arranged at corresponding intersections of the scan lines 221-1, 221-2, . . . , and so on and the signal lines 222-1, 222-2, . . . , and so on. In practice, several hundred thousand to several million pixels 21 are arranged. In this case, however, nine pixels 21 arranged in a matrix having three rows and three columns are shown for simplicity of illustration.

<Pixel Configuration>

Each pixel 21 has, for example, a pixel transistor 211, a liquid crystal element (a liquid crystal capacitor) 212, and a storage capacitor 213. The pixel transistor 211 is implemented by, for example, a thin-film transistor (TFT). The pixel transistors 211 have gate electrodes that are connected to the corresponding scan lines 221-1, 221-2, and 221-3 and source electrodes that are connected to signal lines 222-1, 222-2, and 222-3.

The liquid crystal element 212 represents liquid-crystal-material capacitance components generated between a pixel electrode and an electrode disposed to oppose the pixel electrode. The pixel electrode is connected to a drain electrode of the corresponding pixel transistor 211. A common potential VCOM of a direct-current voltage is applied to the opposing electrodes of the liquid crystal elements 212 of all pixels 21. The storage capacitor 213 has one electrode that is connected to the pixel electrode of the liquid crystal capacitance 212, and another electrode of the storage capacitor 213 is connected to the opposing electrode of the liquid crystal element 212.

In the pixels 21 having the above-described configuration, the pixel transistors 211 are put into electrically connected states for each row through vertical scanning performed by the vertical drive circuit 23, so that the corresponding pixels 21 receive video signals Vsig supplied from the horizontal drive circuit 24 through the signal lines 222-1, 222-2, and 222-3. Voltages of the received video signals Vsig are applied to the liquid crystal elements 212 and are also stored by the storage capacitors 213. The storage capacitors 213 store the potentials until the pixel transistors 211 in the corresponding pixels 21 are put into electrically connected states again.

<Vertical Drive Circuit>

The vertical drive circuit 23 includes, for example, a shift register and an output circuit. The number of shift stages and the number of output stages may correspond to the number of rows (in this example, three) in the pixel array section 22. The vertical drive circuit 23 sequentially outputs scan pulses via output ports of the vertical drive circuit 23. The output ports are connected to corresponding ends of the scan lines 221-1, 221-2, and 221-3.

By sequentially outputting the scan pulses via the output ports, the vertical drive circuit 23 selects the pixels 21 in the pixel array section 22 through the scan lines 221-1, 221-2, and 221-3 while performing time-division scanning for each row.

The vertical drive circuit 23 puts the pixel transistors 211 into electrically connected states by using the scan pulses, so that the video signals Vsig supplied from the horizontal drive circuit 24 through the signal lines 222-1, 222-2, and 222-3 are written to the pixels 21 in a selected row.

<Horizontal Drive Circuit>

The horizontal drive circuit 24 includes, for example, a shift register 241 and analog switches (hereinafter referred to as "horizontal switches") HSW1 to HSW3. The number of shift stages (which are unit circuits of the shift registers 241) in the shift register 241 and the number of horizontal switches HSW1 to HSW3 may correspond to the number of columns (in this example, three) in the pixel array section 22.

The shift register 241 sequentially outputs switch control pulses (sample hold pulses) SHP1 to SHP3 via the corresponding shift stages. The horizontal switches HSW1 to HSW3 are driven by the switch control pulses SHP1 to SHP3, sequentially output from the shift register 241, to output the video signals Vsig to the pixels 21 in a row selected by the vertical drive circuit 23. More specifically, for example, for each line (row) or for multiple lines, the horizontal switches HSW1 to HSW3 dot sequentially output the video signals Vsig, input from the outside of the liquid crystal panel 20 through a video-signal supply line 242, through the signal lines 222-1, 222-2, and 222-3 in one horizontal period.

Although the description in this case has been given of an example of a dot-sequential drive system in which the video signals Vsig are dot-sequentially output to the pixels 21 in a selected pixel row, the drive system for the horizontal drive circuit 24 is not limited to the dot-sequential drive system. For example, it is possible to employ a line-sequential drive system in which the video signals Vsig are simultaneously output to the pixels 21 in a selected pixel row.

<Precharge Circuit>

The precharge circuit 25 includes analog precharge switches PSW1 to PSW3, which are provided so as to correspond to the signal lines 222-1, 222-2, and 222-3. The precharge circuit 25 writes a precharge signal Psig having a predetermined level to the signal lines 222-1, 222-2, and 222-3, before the horizontal drive circuit 24 writes the video signals Vsig to the signal lines 222-1, 222-2, and 222-3. More specifically, in a period other than the video-signal Vsig write period, for example, in a horizontal blanking period, the precharge signal Psig is supplied to the signal lines 222-1, 222-2, and 222-3 under the control of a precharge control pulse PCG.

(Light Source Section)

Figure 3:
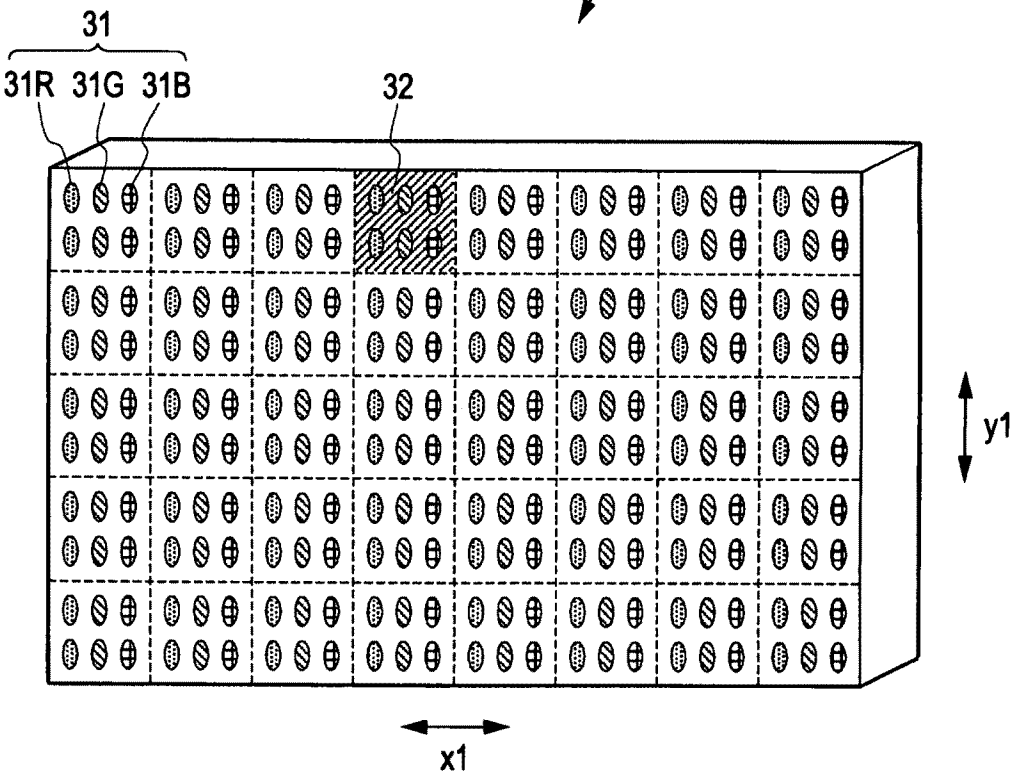
FIG. 3 is a schematic perspective view showing one example of the configuration of a light source section, viewed from an illumination surface side thereof.

FIG. 3 is a schematic perspective view showing one example of the configuration of the light source section 30, viewed from its light-emitting surface side. As described above, the light source section 30 is disposed at the backside of the liquid crystal panel 20 and serves as a backlight that illuminates the liquid crystal panel 20. The light source section 30 has light-emitting elements (light sources), which are implemented by, for example, LEDs (light emitting diodes). The light-emitting elements, however, are not limited to the LEDs.

As shown in FIG. 3, the light source section 30 has multiple light sources 31, which are arranged in a two-dimensional plane to provide a light emitting area. The light emitting area is divided into n (the vertical direction)×m (the horizontal directions) partial light-emitting areas 32. Under the control of the display control section 40 and the light-source drive section 60, independent light-emission driving is performed for each partial light-emitting area 32 in the light source section 30 in accordance with an input image signal (video signal).

That is, the light-source section 30 employs a partial drive system in which light-emission driving is performed independently for each partial light-emitting area 32. With the partial drive system, the luminance and chromaticity of the backlight can be partially changed in accordance with video to be displayed. Thus, it is possible to achieve a luminance reproduction range (a dynamic range) that exceeds a contrast ratio limit for liquid crystal display and it is also possible to display colors. Details of the control performed by the display control section 40 and the light-source drive section 60 are described below.

Each light source 31 has, at least, a combination of a red LED 31R that emits red light, a green LED 31G that emits green light, and a blue LED 31B that emits blue light. Under the control of the light-source drive section 60, the light source 31 emits primary-color light through independent light emission (lighting) of the LED 31R, 31G, and 31B and emits achromatic-color light or complementary-color light through additive color mixing of the color lights. The term "achromatic color" herein refers to black, gray, and white that have only brightness among hue, brightness, and saturation, which are three attributes of color. Hereinafter, the achromatic color is simply referred to as "monochrome" color.

That is, the light emitting section 30 includes a plurality of partial light-emitting areas 32, which are spatially divided in a matrix having y1 (the vertical direction) by x1 (the horizontal direction) areas. The light emitting section 30 serves as a color backlight having a function that is capable of performing color display with a lower resolution than the resolution of the liquid crystal panel 20 by partial light emission of the partial light-emitting areas 32. It is desired that the number of divided partial light-emitting areas 32 satisfy $y1 \leqq y2$ and $x1 \leqq x2$, where the number of pixels in the liquid crystal panel 20 is expressed by y2 (the vertical direction)×x2 (the vertical direction). In general, the resolution of the light source section 30 is set rough (low) compared to the liquid crystal panel 20. The present inventors confirmed that it is preferable that number of (y1×x1) partial light-emitting areas 32 be about 3000 or less.

(Display Control Section)

A description will now be given with reference back to FIG. 1. It is assumed that, for example, R, G, and B image signals are input to the display control section 40. The display control section 40 performs various types of signal processing on the R, G, and B image signals and also performs control for driving display of the liquid crystal panel 20 and for driving lighting of the light source section 30. The display control section 40 according to the present embodiment employs a field sequential system as a system for driving the liquid crystal panel 20 and the light source section 30. In the field sequential system, color display is performed by lighting each pixel in one frame in a time division manner using three or more unit colors including at least R, G, and B.

In a typical field sequential system, in synchronization with display driving of the liquid crystal panel 20, color of light emitted by the light source 31 is divided along a time axis to perform driving for causing, for each field, independent light emission of a single one of, for example, the R, G, and B primary colors. When the field sequential system is employed, the liquid crystal panel 20 may be implemented by a monochrome-image display light-transmitting panel that lacks a high-cost color filter for color discrimination. Lack of the color filter can improve the utilization rate of light emitted from the light emitting section 30.

The scheme according to the embodiment of the present invention provides a system (which is described below) that allows an image portion of other colors to be displayed on the same screen, without a color filter, through backlight control of the like. Thus, under the control of the display control section 40, the scheme according to the embodiment of the present invention can achieve the following control. That is, the liquid crystal panel 20 and the light source section 30 cooperate and synchronize with each other to display a color field screen on which two or more unit-color-based colors are shown, and also achieve color display by superimposing n field screens in a time direction according to an additive-color-mixing principle. More specifically, although a color image on each independent unit-color-based field screen is spatially incomplete, the images are superimposed as integration of multiple fields in a time axis direction. The fields are temporally integrated together on the human retina to thereby make it possible to restore/reproduce one frame image.

The term "frame" herein refers to a unit that provides an image (video). One image corresponds to one frame and multiple fields constitute one frame. In the present embodiment, a description is given assuming that, in the field sequential system, n field images (n=2 or greater) are combined to provide one frame image. The fields may also be referred to as "sub-frames".

The display control section 40 has a computational algorithm circuit 41 and a reference-white-value setup memory 42. The display control section 40 further has, at the input side of the computational algorithm circuit 41, resolution-reduction and lighting-amount-control sections 43R, 43G, and 43B and memories 44R, 45R, 44G, 45G, 44B, and 45B so as to correspond to the R, G, and B image signals. The display control section 40 further has, at the output side of computational algorithm circuit 41, luminance-increase/reduction processing sections 46A, 46B, and 46C and division circuit sections 47A, 47B, and 47C so as to correspond to three fields A, B, and C.

For example, the computational algorithm circuit 41 performs optical linearization; separation processing for color components, complementary-color components, and primary-color components; comparison between the blocks (the partial light-emitting areas 32) of the light source section 30; computation for image data and lighting level data; inter-field computation; interchanging and exchanging; and control for field switching. The reference-white-value setup memory 42 stores predetermined reference-white values. Details of the terms, such as the white components, the complementary-color components, the primary-color components, and the reference-white values are described below.

With respect to the input R, G, and B image signals, the resolution-reduction and lighting-amount-control sections 43R, 43G, and 43B perform resolution-reduction processing corresponding to the number of divided areas of the light source section 30 and also control the amounts of lighting of the light sources 31 of the light source section 30. The memories 44R, 44G, and 44B store data regarding the amounts of lighting of the light sources 31 controlled by the resolution-reduction and lighting-amount-control sections 43R, 43G, and 43B. The memories 45R, 45G, and 45B store data of R, G, and B images.

The luminance-increase/reduction processing sections 46A, 46B, and 46C perform luminance-increase/reduction processing on the RGB backlight lighting-amount data subjected to the computational processing performed by the computational algorithm circuit 41 and output therefrom. The RGB backlight lighting-amount data are generated based on information, such as profile data (luminance distribution data), of the light source section 30. The profile data is preheld by the computational algorithm circuit 41. The term "profile data" herein refers to data of the degree of partial brightness (i.e., the degree of luminance blur and the luminance distribution) when the light source section (backlight) 30 is partially driven.

The RGB backlight lighting-amount data (B) subjected to the luminance-increase/reduction processing performed by the luminance-increase/reduction processing sections 46A, 46B, and 46C are supplied to the division circuit sections 47A, 47B, and 47C, respectively, and are also selectively supplied to the light-source drive section 60 via a switch section 90 as drive signals for the light-source drive section 60. The division circuit sections 47A, 47B, and 47C divide the RGB-corrected image data (A), subjected to the computation processing performed by the computational algorithm circuit 41 and output therefrom, by the RGB backlight lighting-amount data (B), subjected to the luminance-increase/reduction processing performed by the luminance-increase/reduction processing sections 46A, 46B, and 46C, respectively. The results of the division (A/B) performed by the division circuit sections 47A, 47B, and 47C are selectively supplied to the liquid crystal panel 20 via the switch section 90 as drive signals for the liquid crystal panel 20.

(Photodetector Section)

The photodetector section 50 detects the amounts of lighting/the amounts of illumination (luminance) of the light sources 31 (the LEDs 31R, 31G, and 31B) of the light source section 30.

(Light Source Drive Section)

As shown in FIG. 1, the light-source drive section 60 includes an A/D (analog/digital) converter 61, a chromaticity/luminance data detector 62, a constant-current circuit sections 63R, 63G, and 63B, drive circuit sections 64R, 64G, and 64B, and a D/A (digital/analog) converter 65. Using pulsed PWM (pulse width modulation) signals as LED drive signals, the light-source drive section 60 performs illumination control by performing PWM control on the color LEDs 31R, 31G, and 31B.

The A/D converter 61 in the light-source drive section 60 converts an analog detection signal, input from the photodetector section 50, into a digital detection signal. On the basis of the detection signal input from the photodetector section 50, the chromaticity/luminance data detector 62 detects chromaticity/luminance data of the light sources 31 and outputs the detected chromaticity/luminance data. The chromaticity/luminance data detected by the chromaticity/luminance data detector 62 is supplied to the luminance-deviation/chromaticity controlling and aging-related-deterioration correcting section 80 and is used for feedback control of the color LEDs 31R, 31G, and 31B.

The constant-current setting section 70 sets constant-current setting signals and outputs the constant-current setting signals to the corresponding constant-current circuit sections 63R, 63G, and 63B of the light-source drive section 60. On the basis of the constant-current setting signals, the constant-current circuit sections 63R, 63G, and 63B supply constant currents to the color LEDs 31R, 31G, and 31B, respectively. On the basis of the LED drive signals supplied from the display control section 40, the drive circuit sections 64R, 64G, and 64B drive the color LEDs 31R, 31G, and 31B, respectively.

On the basis of the chromaticity/luminance data supplied from the chromaticity/luminance data detector 62 in the light-source drive section 60, the luminance-deviation/chromaticity controlling and aging-related-deterioration correcting section 80 performs control for the luminance deviation and chromaticity (white balance (W/B) of the light sources 31 and also performs correction for aging-related deterioration.

<Color Breakup>

Now, a typical field sequential system when the light source section 30 is partially driven to perform illumination driving independently for each partial light-emitting area 32 will be discussed with reference to FIG. 4. In this context, a case in which the light source section 30 is driven to perform time-division illumination for each of the unit colors R, G, and B at a drive frequency of, for example, 120 Hz will be described by way of example.

Figure 4:
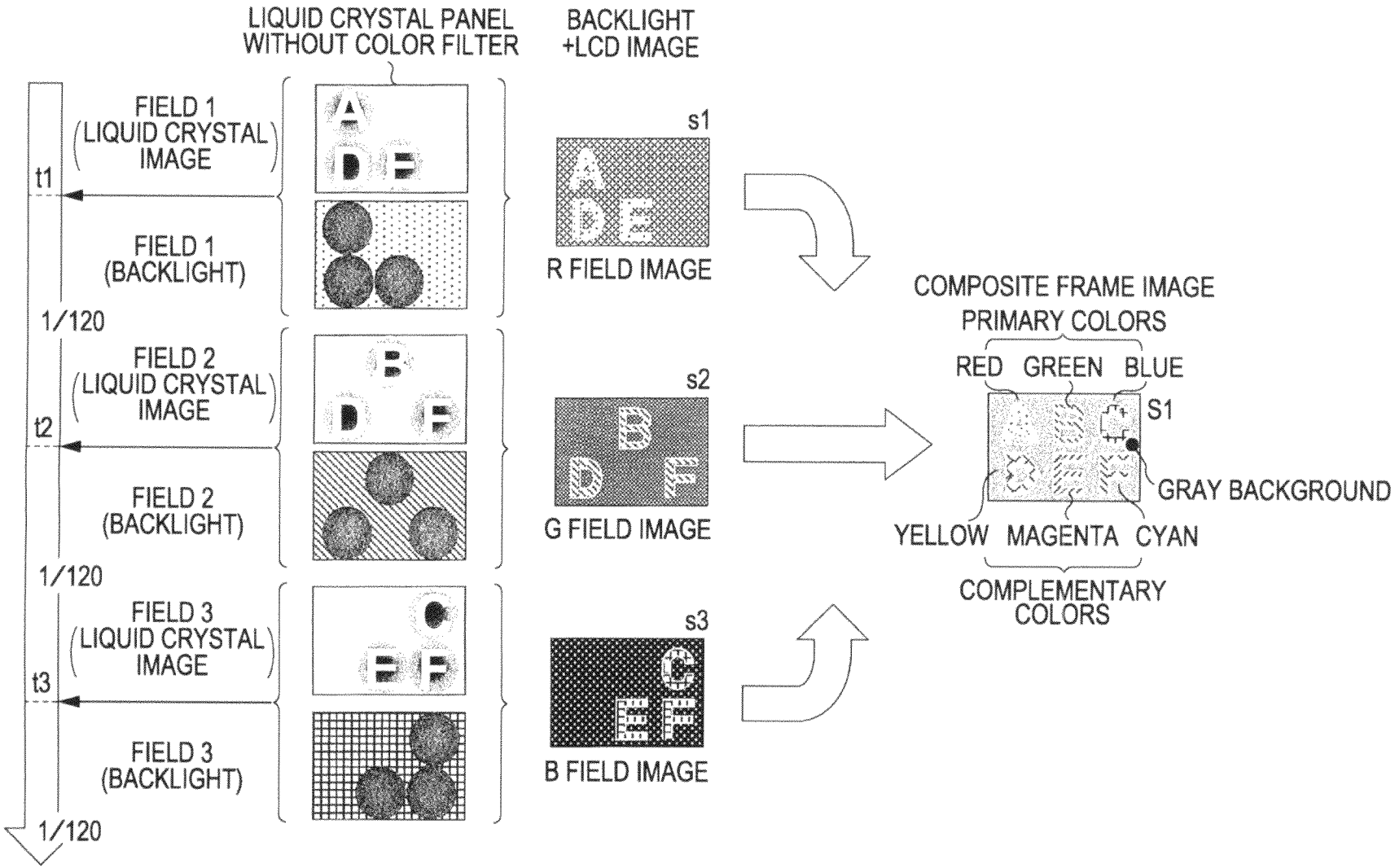
FIG. 4 illustrates color breakup in a field sequential system of related art.

Referring to FIG. 4, at time t1, for example, letters "A", "D", and "E" are displayed in monochrome color on the liquid crystal panel 20, and the red LEDs 31R in the light source section 30 are lit and driven. At this point, in the light source section 30, the red LEDs 31R in the partial light-emitting areas 32 at portions correspond to the letters "A", "D", and "E" are partially driven so as to emit red light with a predetermined luminance. As a result, an R field screen s1 on which the letters "A", "D", and "E" are shown in red is displayed in a time division manner.

At time t2, for example, letters "B", "D", and "F" are displayed in monochrome color on the liquid crystal panel 20, and the green LEDs 31G in the light source section 30 are lit and driven. At this point, in the light source section 30, the green LEDs 31G in the partial light-emitting areas 32 at portions correspond to the letters "B", "D", and "F" are partially driven so as to emit green light with a predetermined luminance. As a result, a G field screen s2 on which the letters "B", "D", and "F" are shown in green is displayed in a time division manner.

At time t3, the liquid crystal panel 20 displays, for example, letters "C", "E", and "F" in monochrome color, and the blue LEDs 31B in the light source section 30 are lit and driven. At this point, in the light source section 30, the blue LEDs 31B in the partial light-emitting areas 32 at portions correspond to the letters "C", "E", and "F" are partially driven so as to emit blue light with a predetermined luminance. As a result, a B field screen s3 on which the letters "C", "E", and "F" are shown in blue is displayed in a time division manner.

The R, G, and B field screens s1, s2, and s3 are then superimposed on each other as integration of the fields in the time axial direction, that is, are temporally integrated together on the human retina, and are thus seen by the human eye as one frame image S1. In the case of this example, in the frame image S1, the background thereof is displayed in gray, the letters "A", "B", and "C" are displayed in the R, G, and B primary colors, respectively, and the letters "D", "E", and "F" are displayed in complementary colors with Ye (yellow), Mg, (magenta), and Cy (cyan), respectively.

When such partial driving, which is based on the field sequential system, is performed so as to control the luminances of the illumination colors of the partial light-emitting areas 32 at portions that correspond to the character portions and that are included in the light source section 30, the RGB primary colors may flicker but do not cause color breakup. However, with respect to the portions at which the Ye, Mg, and Cy complementary colors are displayed, color breakup occurs because of the RGB time-sequence and low frequencies. When the luminance is increased, the color breakup becomes more significant. With respect to the gray background, color breakup also occurs because of the RGB time sequence.

[Features of Present Embodiment]

The present invention is aimed to more reliably prevent occurrence of color breakup in the field sequential system. One embodiment of the present invention will be described below.

A concept of the present invention will be described first. In this embodiment, a case in which the light source section 30 is driven to perform time-division illumination for each of the unit colors R, G, and B at a drive frequency of, for example, 120 Hz will also be described by way of example. Hereinafter, the partial light-emitting area 32 may be simply referred to as a "block".

In the present embodiment, starting with the typical RGB field division, RGB images are subjected to division for R, G, and B resolution reduction, so that, as in the partial driving described above, the amounts of lighting of the red LED 31R, the green LED 31G, and the blue LED 31B are determined with respect to the R, G, and B images of the blocks (the partial light-emitting areas 32).

The amount of lighting of each block is checked with respect to each color and each block is classified into one of the following three cases:

a white-mixed portion (i.e., a block in which all RGB are lit), a complementary-color portion (a block in which any two of the R, G, and B are lit), and a primary color portion (a block in which only one of the R, G, and B is lit). Processing for the three portions will be described below.

(Processing for White Mixed Portion)

With respect to the white-mixed portion, the amount of lighting of a color of interest in a block and the amount of lighting of the color of interest and other colors in the same block in other fields in the same space are summed, and reference white components and color-constituent components are compared with each other assuming that the RGB colors in the block are lit at the same time. The white reference components are described below. Next, re-allocation processing is performed so that white including a color other than the reference color of a field of interest is dispersed to other fields along the time axis.

Eventually, processing for special cases for complementary colors and the primary colors is performed in combination to provide a state in which the amounts of lighting are re-allocated to the fields. The amounts of lighting of blocks for each field after the allocation are determined, the profile data of the light source section 30 is reconfigured, corresponding states of lighting of the light source section 30 are obtained, and the resulting fields are superimposed to obtain a liquid-crystal-side display image to be cancelled.

Thus, unlike a sequential image that has traditionally been completely divided into homogenous-color fields, i.e., red, green, and blue fields, along the time axis, the system according to present embodiment provides an image in which incomplete color images, including a reddish monochrome image, a greenish monochrome image, and a bluish monochrome image, are field sequentially combined. Herein, the term "time-sequential images" refer to plane images that are sequentially displayed over time.

Blocks in which all R, G, and B are lit have low color purities. Thus, with respect to a block in which all R, G, and B are lit, the reference white components are allocated to the fields to purposely increase the inter-field correlation of the reference white components. With this scheme, even with the liquid crystal panel 20 without a color filter, it is possible to prevent occurrence of color breakup. The term "inter-field correlation" herein refers to a difference in the amounts of lighting between fields. That is, a small difference in the amounts of lighting represents a large (high) inter-field correlation, and a large difference in the amounts of lighting represents a small (low) inter-field correlation.

In addition, this scheme can increase the field frequency at which the reference white components are displayed, thus making it possible to improve visual response to moving images.

(Processing for Complementary Color Portion)

The complementary color portion refers to a portion at which the RGB lighting state in a block of interest can be regarded as being represented by a complementary color composed of almost two of the R, G, and B colors (i.e., by a color that lies on an edge of or slightly inward of a chromaticity triangle in an RGB chromaticity diagram). With respect to the complementary color portion, a complementary color obtained by extinguishing, of a ratio (a mixing ratio) of R, G, and B that constitute the reference white, a predetermined one color that becomes a complementary color is used as a reference complementary color, and this reference complementary color is equally allocated to the fields in accordance with a crosstalk condition example described below. This is aimed to minimize the phenomenon of color breakup at complementary-color display portions.

The area of blocks to be examined is increased or reduced depending on the number of divided blocks in the area and the amount of crosstalk which depends on the optical design. A determination is made as to whether or not neighborhood blocks of complementary-color display blocks have an amount of lighting of the primary color, and when a color other than two primary colors that constitute a complementary color is found, the following processing is performed. The term "neighborhood blocks" herein refer to blocks located in a range affected by crosstalk.

For example, when a complementary color in a block of interest is cyan composed of green and blue and red-primary-color blocks exist in the neighborhood of the block of interest, red is displayed in only a red field. Rather than lighting only green in the green field and only blue in the blue field, cyan is displayed while being based on the green field and cyan is displayed while being based on the blue field. With this scheme, the complementary color can be directly displayed in each field without interference of crosstalk in the neighborhoods. Consequently, dolor components of a complementary color are not dispersed along the time-axis direction, thus making it possible to prevent occurrence of color breakup.

As a determination condition other than the above-described condition example, a determination is made as to whether or not a block of interest that displays a complementary color has, in its neighborhood in each field, a block that displays a primary color other than the complementary color of the block of interest and as to whether or not the block of interest has a neighborhood block that displays a complementary color other than the complementary color of the block of interest. When colors other than colors indicated by ● in Table 1 below are not present in the neighborhood blocks, processing as shown in Table 1 is executed to directly display a complementary color spatially in each field and the color separation in the time-axis direction is suspended.

TABLE 1

| Block of Interest | | Neighborhood Block (Increase/Reduction) | | | | | | | |
|---|---|---|---|---|---|---|---|---|---|
| Complementary Color | Constituent Primaries | R | G | B | Ye | Mg | Cy | W | Processing |
| Ye | R, G | | | ● | | | | ● | Directly display Ye in R, G field |
| Mg | R, B | | ● | | | | | ● | Directly display Mg in R, B field |
| Cy | G, B | ● | | | | | | ● | Directly display Cy in G, B field |

In this manner, colors in neighborhood pixels are determined and a determination is made as to whether or not the amounts of lighting can be moved across the fields. Although details are not given, the amounts of lighting are determined taking the degrees of lighting of blocks into account.

(Processing for Primary Color Portion)

In principle, with respect to primary-color portions in a displayed image, a field in which a reference color (a primary color) dedicated thereto is to be mainly displayed is set and the light of the primary color is lit in the set field. However, when condition (1) of conditions (1) to (4) described below is satisfied, the amount of lighting is allocated to the fields without application of that principle. A description below will be given assuming that a color of interest is R and other colors are G and B.

The amount of lighting of the color of interest in a block of interest is compared with the amounts of lighting of other colors in neighborhood blocks thereof, the block of interest and the neighborhood blocks being located in the same space. When the amount of crosstalk is small, processing for dispersion along the time axis is performed to also disperse the primary color itself to the fields for display. This processing serves as flicker prevention processing for increasing the inter-field correlation. In particular, when condition (1) below is satisfied on the basis of the amount of lighting of the color of interest and the amounts of lighting of other colors in the neighborhood blocks, one third of the amount of lighting can be lit in each frame.

Condition (1)

In a neighborhood block, the amount of lighting of the color (R) of interest is small (i.e., is smaller than a predetermined amount) and the amount of lighting of another color (GB) is small→the primary color (R) portion can be moved to or dispersed to the independently lit color (GB).

Condition (2)

In a neighborhood block, the amount of lighting of the color (R) of interest is large (i.e., is larger than the predetermined amount) and the amount of lighting of another colors (GB) is small→the primary color (R) portion is displayed in the field of the color (R) of interest (i.e., is directly lit in the primary-color-based field).

Condition (3)

In a neighborhood block, the amount of lighting of the color (R) of interest is small and the amount of lighting of another color (GB) is large→the primary color (R) portion is displayed in the field of the color (R) of interest (i.e., is directly lit in the primary-color-based field).

Condition (4)

In a neighborhood block, the amount of lighting of the color (R) of interest is large and the amount of lighting of another color (GB) is large→the primary color (R) portion is displayed in the field of the color (R) of interest (i.e., is directly lit in the primary-color-based field) (a complementary color in the neighborhood block).

(White Color Components, White Difference, Reference Complementary-Color Components, and Complementary Color Difference)

A description is now given of definitions of white color components, a white difference, reference complementary-color components, a complementary color difference which are used for display driving according to the present embodiment of the present invention.

<Reference White Components>

White of the light source 31 when the color temperature (e.g., the so-called "white-balance color temperature") thereof is set to its reference color temperature is defined as reference white W(ref). In the following description, the reference white W(ref) is assumed to be given by:

$$W(ref)=(1\cdot R)+(1\cdot G)+(1\cdot B) \quad (1)$$

where R, G, and B indicate the R, G, and B intensities (the amounts of lighting/the amount of light), respectively.

Figure 5A:
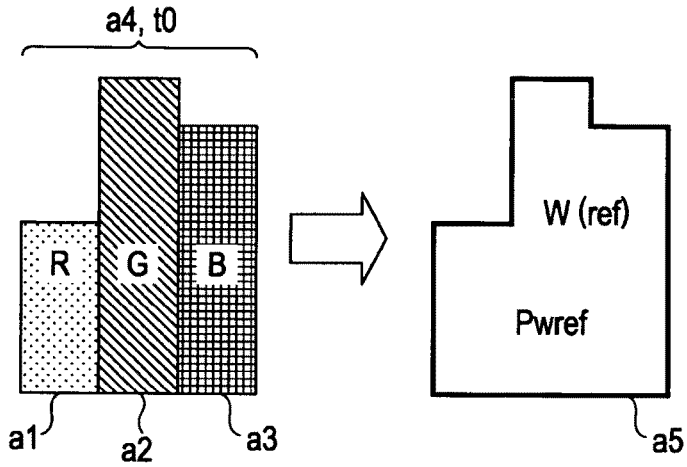
FIGS. 5A and 5B show a relationship between the ratios of intensities of reference colors, which are R, G, and B in this example, and the ratios of intensities of a mixed white.

This will be described below in more detail with reference to FIGS. 5A and 5B. FIG. 5A shows the ratios of intensities of reference colors, which are R, G, and B in this example, and the ratios of intensities of a mixed white. Bar graphs a1 to a3 indicate the intensities of the respective colors. More specifically, the bar graph a1 indicates a red intensity R, the bar graph a2 indicates a green intensity G, and the bar graph a3 indicates a blue intensity B. In FIG. 5A, an arc a4 collectively indicates all the bar graphs a1, a2, and a3 for the respective intensities R, G, and B, and time t0 indicates specified time, at which the color LEDs 31R, 31G, and 31B simultaneously emit light with the corresponding intensities R, G, and B.

In FIG. 5A, a white-colored polygon a5 represents a case in which white obtained by mixing the light colors having the intensities R, G, and B indicated by the bar graphs a1, a2, and a3 is regarded as a white chromaticity reference. The mixed-light white W represented by the polygon a5 is assumed to be the reference white W(ref), and intensity Pw of the reference color W(ref) is indicated by Pwref.

Figure 5B:
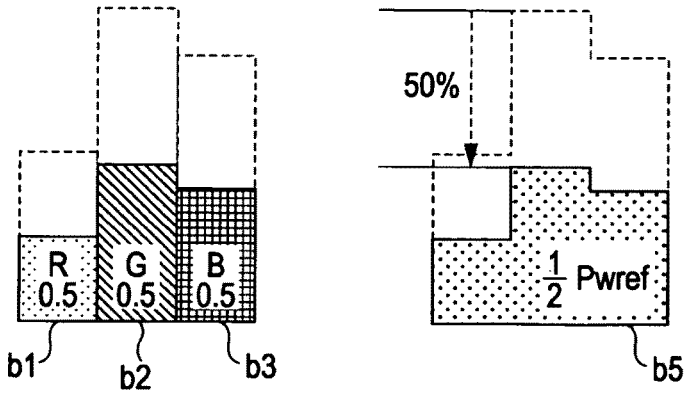

In FIG. 5B, bar graphs b1 to b3 indicate a case in which the intensities of colors is one-half of those shown in FIG. 5A. That is, the bar graph b1 indicates a red intensity 0.5R, the bar graph b2 indicates a green intensity 0.5G, and the bar graph b3 indicates a blue intensity 0.5B. A polygon b5 represents mixed light of the colors having the intensities 0.5R, 0.5G, and 0.5B indicated by the bar graphs a1, a2, and a3. Since the mixed light represented by the polygon b5 has the same mixing ratio as the reference white W(ref), the color temperature is the same, but the intensity is half the intensity Pwref of the reference white W(ref), i.e., is expressed by Pwref/2.

<White Difference>

A description is now given of a definition of a quantity referred to as a "white difference", which is an important concept in the present invention. The term "white difference" used herein refers to the level of a reference-color difference in displayed color from the reference white adjusted according to the white balance. The quantity referred to as the "white difference" will now be described below in conjunction with an example using a constituent ratio of signal levels and illuminations of a block of interest and other blocks of each of R, G, and B of an extracted area having m×n pixels in a plane parallel to the screen.

Figure 6:
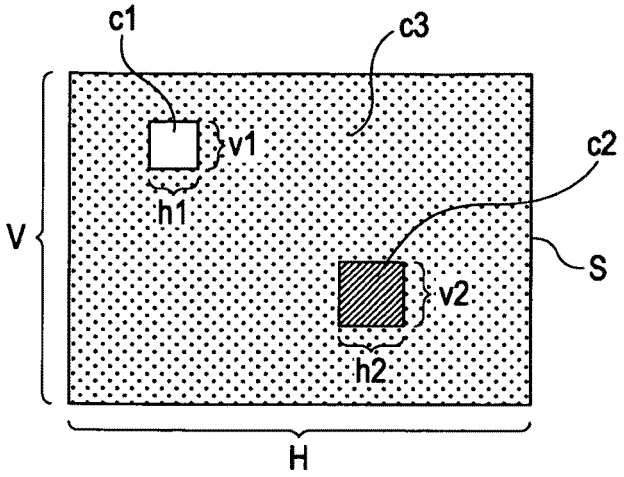
FIG. 6 shows a reference screen S.

FIG. 6 shows a reference screen S. In FIG. 6, V indicates the vertical screen size of the reference screen S and H indicates the horizontal screen size of the reference screen S. Further, c1 indicates an area having v1 (the vertical direction)×h1 (the horizontal direction) pixels on the reference pixel S, c2 indicates an area including v2 (the vertical direction)×h2 (the horizontal direction) pixels, and c3 indicates an area other than the areas c1 and c2.

In a plane parallel to a still-image display screen in an arbitrary frame, a representative color in an area from which m×n pixels are extracted has a chromaticity value expressed by W(k, j). The chromaticity value W(k, j) is assumed to be expressed by:

$$W(k,j)=\alpha(aR+bG+cB) \quad (2)$$

where (k, j) in W(k, j) indicates, for example, coordinates of a horizontal pixel position k and a vertical pixel position j on the liquid crystal panel 20. Furthermore, (k, j) may be regarded as coordinate values (corresponding to a pixel) of one of the divided blocks (the partial light-emitting areas 32) in the light source section 30.

In equation (2), α is a coefficient indicating the degree of the intensity of the total amount of light when the ratio of R, G, and B constituting the color is constant. That is, α is a coefficient indicating that the luminance is variable when the chromaticity point is constant. In equation (2), a, b, and c indicate the ratio of the intensities of unit-color lights included in given white to those of the reference white W(ref).

Figure 7:
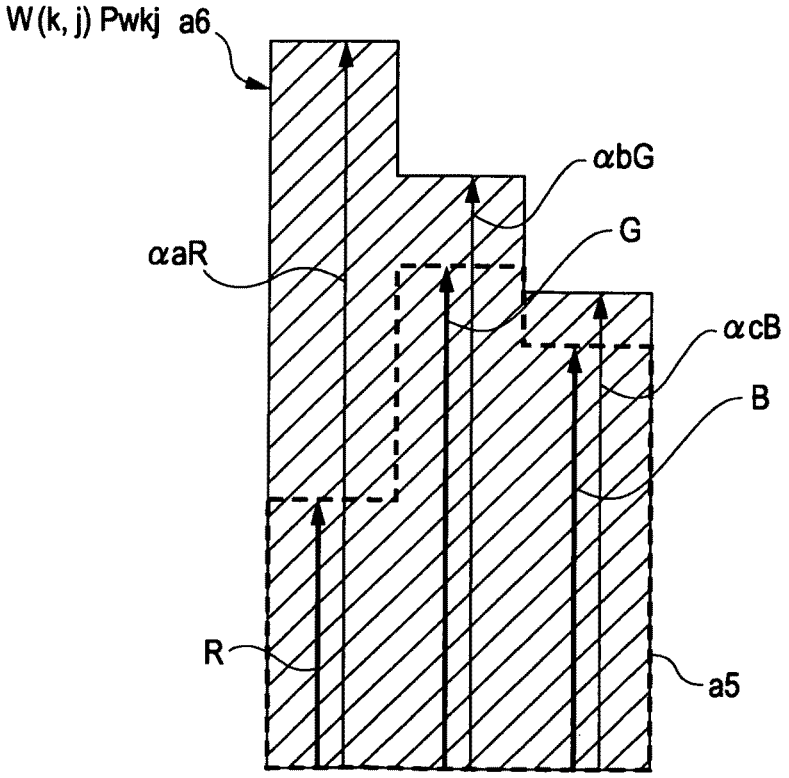
FIG. 7 is a diagram showing a difference between RGB intensity components of a reference white Wref and a white color W(k, j)

More specifically, as shown in FIG. 7, with respect to respective total amounts of R, G, and B constituting the reference white W(ref) and intensity ratios of a monochrome color to each R, G, and B, R is a αa multiple, G is a αb multiple, and B is a αc multiple.

In FIG. 7, the chromaticity value W(k, j) indicated by a polygon a6 is equivalent to a diagrammatic representation of equation (2). The coefficient α indicates the intensity of the total amount of light when the ratio of R, G, and B constituting the white is constant. Thus, level differences from R, G, and B of the reference white are compared with each other for the respective colors, a multiplying factor of the monochrome color having the smallest one of the level differences is determined, and the entire RGB levels are multiplied by the multiplying factor.

Under the premise described above, a quantity referred to as a "white difference ΔW(ref)" is defined relative to the reference white W(ref). The white difference ΔW(ref) is expressed by:

$$\Delta W(ref)=W(k,j)-k\cdot W(ref) \quad (3)$$

where k indicates a coefficient.

It is now assumed that, of the coefficients αa, αb, and αc (in equation (2)) for the respective colors, a smallest value thereof is extracted through comparison. In this case, when ac is assumed to be the smallest coefficient, the chromaticity value W(k, j) can be expressed by the reference white W(ref) and a deviation from αc. That is, the chromaticity value W(k, j) is given as equations (4) and (5):

$$W(k,j)=\alpha(cR+cG+cB)+\alpha[(a-c)R+(b-c)G+(c-c)B] \quad (4)$$

Then, the term (c−c) B disappears to yield:

$$W(k,j)=\alpha[cW(ref)+(a-c)R+(b-c)G] \quad (5)$$

This equation expresses that the chromaticity value W(k, j) is equal to a value obtained by adding the (a−c) multiple of R and the (b−c) multiple of G to the white components of the light sources.

Figure 8:
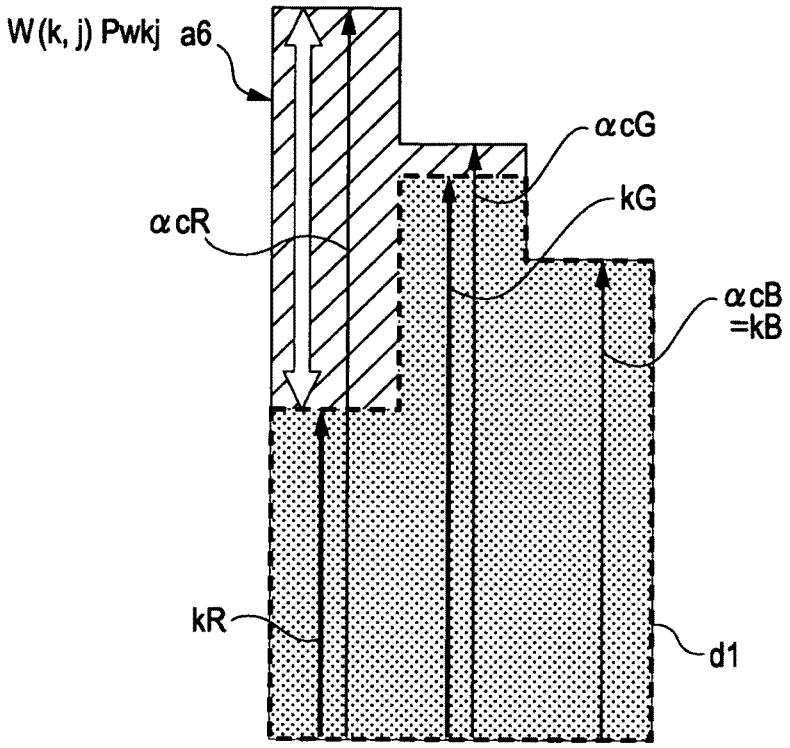
FIG. 8 is a diagram showing a difference between RGB intensity components of the reference white Wref and the white color W(k, j)

That is, since the coefficient ac is the smallest in FIG. 7, computation of a value obtained by multiplying the polygon a5 (see FIG. 5A) by αc provides a polygon d1 shown in FIG. 8. The polygon d1 in FIG. 8 indicates an intensity representation of the reference white W(ref) obtained by the multiplication of k (=αc). The remaining difference indicated by the hatched portion corresponds to ΔW(ref), which represents color intensity components of a difference (remainder) that deviates from the reference white W(ref).

Based on ΔW(ref) that can be expressed by equation (3), the diagrammatic representation indicating that the chromaticity value W(k, j) represented by the polygon a6 is a combination of the hatched portion and the plain portion is formulated as equation (5).

For display of each homogenous primary color (such as R, G, or B) or a complementary color (such as Ye (yellow) composed of R and G colors, Cy (cyan) composed of G and B, and Mg (magenta) composed of R and B), the white difference therefor has its maximum value.

That is, in equation (3), the primary colors and complementary colors can be said as light having no reference white components (i.e., the portion represented by k·W(ref)), and therefore, k is 0. Thus, those colors are not correctly expressed using the reference white W(ref), and thus processed using a component ratio of each complementary color. In this case, the chromaticity value W(k, j) is no longer physically white, but the white difference ΔW(ref) has a maximum value.

The white difference ΔW(ref) according to the definition herein can also be referred to as "primary-color chromaticity" (which is a quantity similar to color purity). That is, when one says that the white difference ΔW(ref) is high, it can be restated as "the chromaticity is high", since it means that the color of interest indicates a color on an edge (on which the amount of reference-white light components is small) of the triangle connecting the primary-color points on the CIE chromaticity diagram. Thus, a high white difference ΔW(ref) can be re-stated as a high chromaticity.

<Reference Complementary-Color Components/Complementary Color Difference>

A complementary color that lacks one color from the reference white W(ref) is defined as a reference complementary color P(ref) and a complementary-color-type color that lacks one color is defined as P(k, j). It is also assumed that a ratio of components relative to the missing color is obtained and a complementary-color difference ΔP(ref) is also extracted in the same manner as the white difference ΔW(ref). The amount of lighting that is proportional to the reference white W(ref) and the reference complementary-color P(ref) is allocated to fields, for lighting, according to an algorithm described below.

<Extending Range of Application of Definition>

The above description has been given of, as one example of additive color mixing, a case in which spatial mixing is performed with respect to the area c1 defined by m×n pixels (see FIG. 6) in the plane parallel to the screen and also a case in which the white difference ΔW(ref) is defined.

In practice, however, since the actual image is a moving image, not a still image, the white difference ΔW(ref) has variations in the time-axis direction. For a television system, an image displayed changes for each image frame that is continuously fed and reproduced. Thus, needless to say, the white difference ΔW(ref) has a value corresponding to a displayed image that varies for each image frame, and thus the concept described above is also extended to the values along the time axis.

Figure 9:
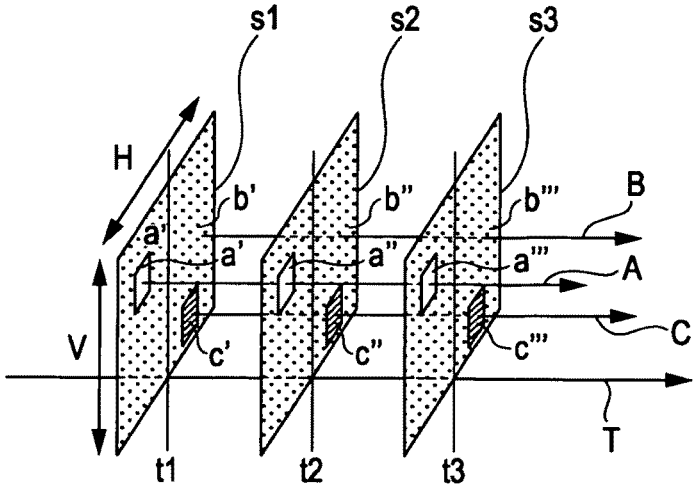
FIG. 9 shows changes in the reference screen S (shown in FIG. 6) over time.

FIG. 9 shows changes in the reference screen S (shown in FIG. 6) over time. In FIG. 9, an arrow T indicates a time axis representing a time elapse direction, t1, t2, and t3 indicate times t on the same time axis, and s1, s2, and s3 indicate screens S at times t1, t2, and t3, respectively. Relative to time t2, time t1 is past time and time t3 is future time. That is, in FIG. 9, the left hand side is past and the right hand side is future.

In FIG. 9, a', a", and a'" indicate specific positions (particularly, within the area c1 defined by m×n pixels) on the screen S at times t1, t2, and t3, respectively, and an arrow A indicates a time elapse direction at the specific positions. Similarly, c', c", and c'" indicate specific positions (particularly, within the area c2 defined by v×h pixels) on the screen S at times t1, t2, and t3, respectively, and an arrow C indicates a time elapse direction at the specific positions. Further, b', b", and b'" indicate specific positions other than portions a', a", a'" c', c", and c'" on the screen S at times t1, t2, and t3, respectively, and an arrow B indicates a time elapse direction at the portions b', b", and b'".

Figure 10A:
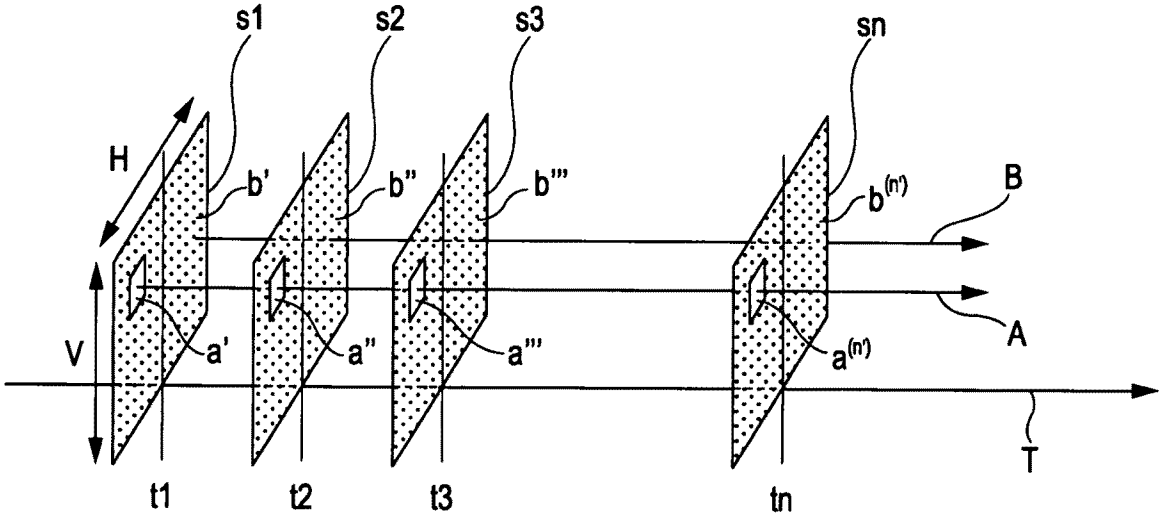
FIGS. 10A and 10B illustrate chromaticity changes at specific positions on the screen S (shown in FIG. 9) when time n passes.
Figure 10B:
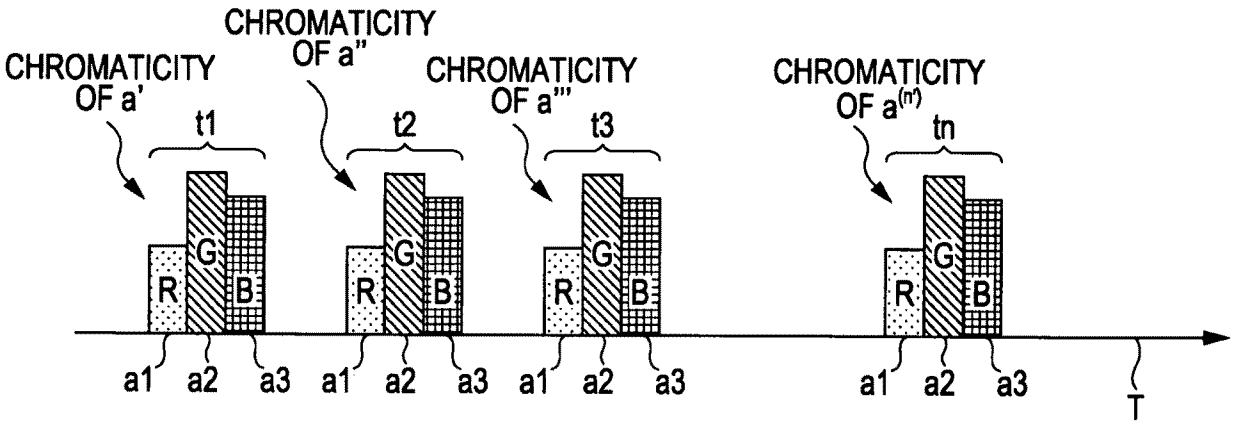

FIGS. 10A and 10B illustrate chromaticity changes at specific positions on the screen S (shown in FIG. 9) when time n elapses. FIG. 10A shows changes at on-screen positions of the screen portion. FIG. 10B shows changes in chromaticity of the screen portion over time.

<White Difference for Temporal Additive Color Mixing>

Next, a description is given of a case in which the white difference ΔW(ref) can also be represented for temporal additive color mixing in which color-light separation and combination are performed in a time axis direction.

As a typical example of the additive color mixing in the time direction, image reproduction based on field sequential representation on homogenous-color screens is available. As described above, the image reproduction method is often applied to a television system that is generally called a field sequential system. This method can achieve color display without use of a color filter.

The definition of the white difference ΔW(ref) in a single image plane for a still image displayed in a given frame has been described above. Similarly, a case in which one frame image is separated into n homogeneous-color screens (n is an integer of 3 or greater), for example, into an R field, a G field, and a B field, will be described by way of example.

A typical concept of the field sequential system is that images having brightnesses of color components of the homogeneous colors (three colors) of R, G, and B are sequentially displayed at times t1, t2, and t3, respectively, so as to cause the colors thereof to be mixed on the retina for image reproduction. When consideration is given to a case in which the values of combination of color light components separated at times t1, t2, and t3 along the time axis are expressed using the reference white W(ref), the constituent ratio of image RGB levels corresponding to the respective times t1, t2, and t3 can be defined in the same manner as the case of the area spatial mixing.

Figure 11:
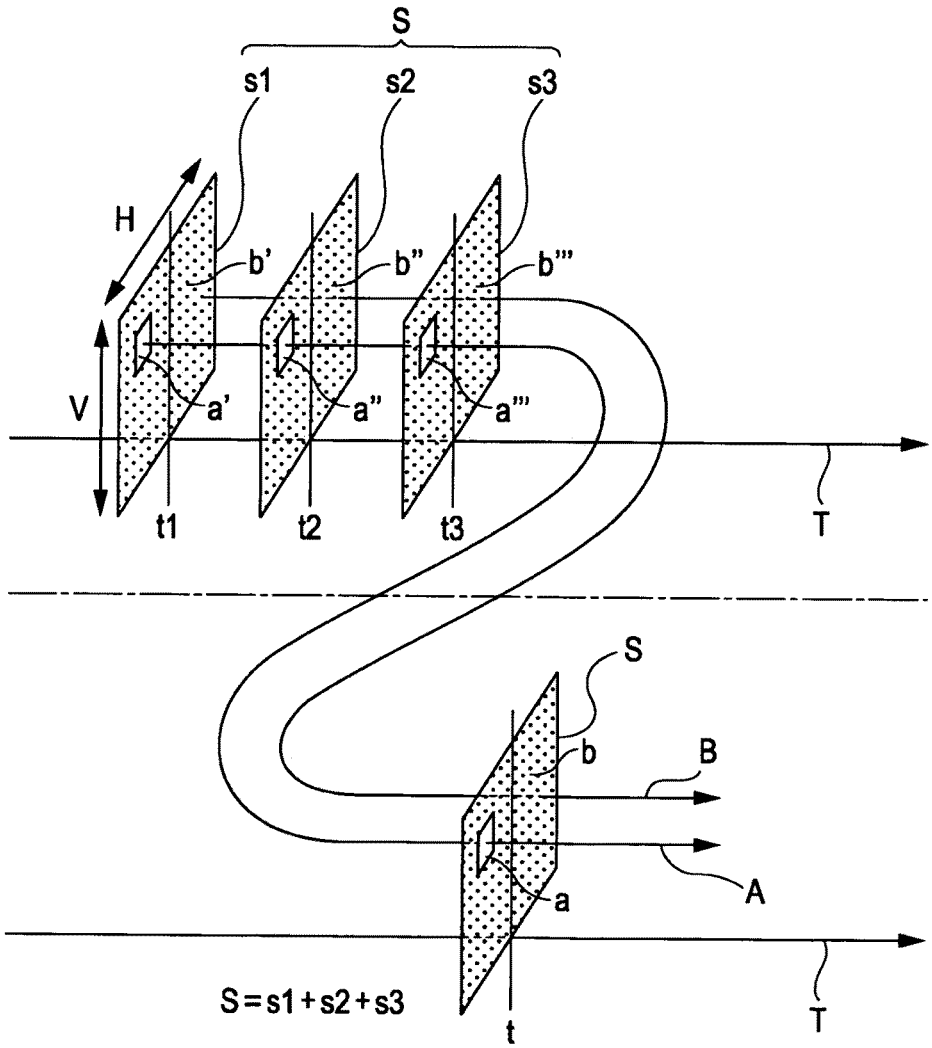
FIG. 11 shows how an on-screen position of a screen portion changes over time, when the screen S is represented by a superimposition of n screens sn in the time axis direction.

This approach will be described below. FIG. 11 shows how the on-screen position of the screen portion changes over time, when the screen S is represented by a superimposition of n screens sn in the time axis direction. FIG. 10 shows how the chromaticity of the screen portion changes over time, when the screen S is represented by a superimposition of n screens sn in the time axis direction.

In the same manner described above, it is now assumed that, in a plane parallel to a still-image display screen in an arbitrary frame, the color of an area defined by m×n pixels has a chromaticity value expressed by W(k, j), which is expressed by equation (2) described above.

In this case, in practice, in order to express the area, since the screen s1 at time t1 is an R field screen displayed in red, the chromaticity value W(k, j) is given by:

$$W(k,j)=\alpha(aR+b''0''+c''0'') \tag{6}$$

where G=B=0.

At time t2, since the screen s2 is a G field screen displayed in green, the chromaticity value W(k, j) is given by:

$$W(k,j)=\alpha(a''0''+bG+c''0'') \tag{7}$$

where R=B=0. At time t3, since the screen s3 is a B field screen displayed in blue, the chromaticity value W(k, j) is given by:

$$W(k,j)=\alpha(a''0''+b''0''+cG) \tag{8}$$

where R=G=0.

Figure 12:
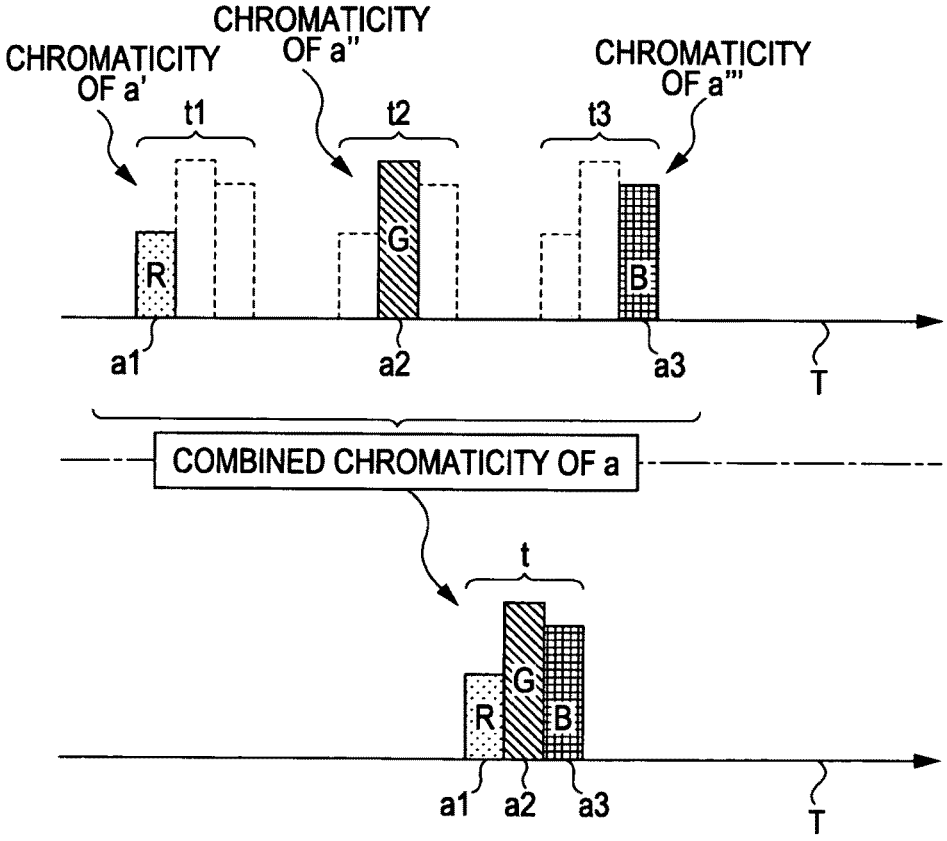
FIG. 12 shows how the chromaticity of the screen portion changes over time, when the screen S is represented by a superimposition of n screens sn in the time axis direction.

In the relationship between the equations and the diagrams shown in FIG. 12, the chromaticity of the specific position a', the chromaticity of the specific position a'', and the chromaticity of the specific position a''' correspond to equation (6), (7), and (8), respectively. The reference white W(ref) which is a combination (integration or sum) of the homogeneous-color screens s1, s2, and s3 in the time-axis direction is given by:

$$W(ref)=\underset{\substack{\uparrow\\ s1}}{\alpha(aR+B''0''+c''0'')}+\underset{\substack{\uparrow\\ s2}}{\alpha(a''0''+BG+c''0'')}+\underset{\substack{\uparrow\\ s3}}{\alpha(a''0''+B''0''+cB)} \tag{9}$$

In equation (9), the three underlined terms on the right-hand side correspond to the states at times t1, t2, and t3, respectively, from the left side. It is to be noted that the states expressed by the three terms do not occur at the same time.

As expressed by equation (9), the existing concept of the field sequential system is aimed to perform color mixing for mixing colors only in the time axis direction without using mixed colors in the space and without use of a color filter. Thus, the exiting concept has one important premise that, at each point of times s1, s2, and s3, the color light components other than one color are 0 in order to correctly represent a mixing ratio and to reproduce color light.

Lights of the colors indicated by the bar graphs a1, a2, and a3 shown in FIG. 12 are not simultaneously lit at times t1, t2, and t3. This is because when colors other than the corresponding colors are illuminated at times t1, t2, and t3 during display of the fields of the screens s1, s2, and s3, the other colors are mixed to thereby reduce the chromaticities, since no color filter is provided and no means for preventing spatial color mixture is present.

The above-described state in which the chromaticities are reduced can be given, as an increase in components W(add), by equation (10) below and FIG. 13.

Figure 13:
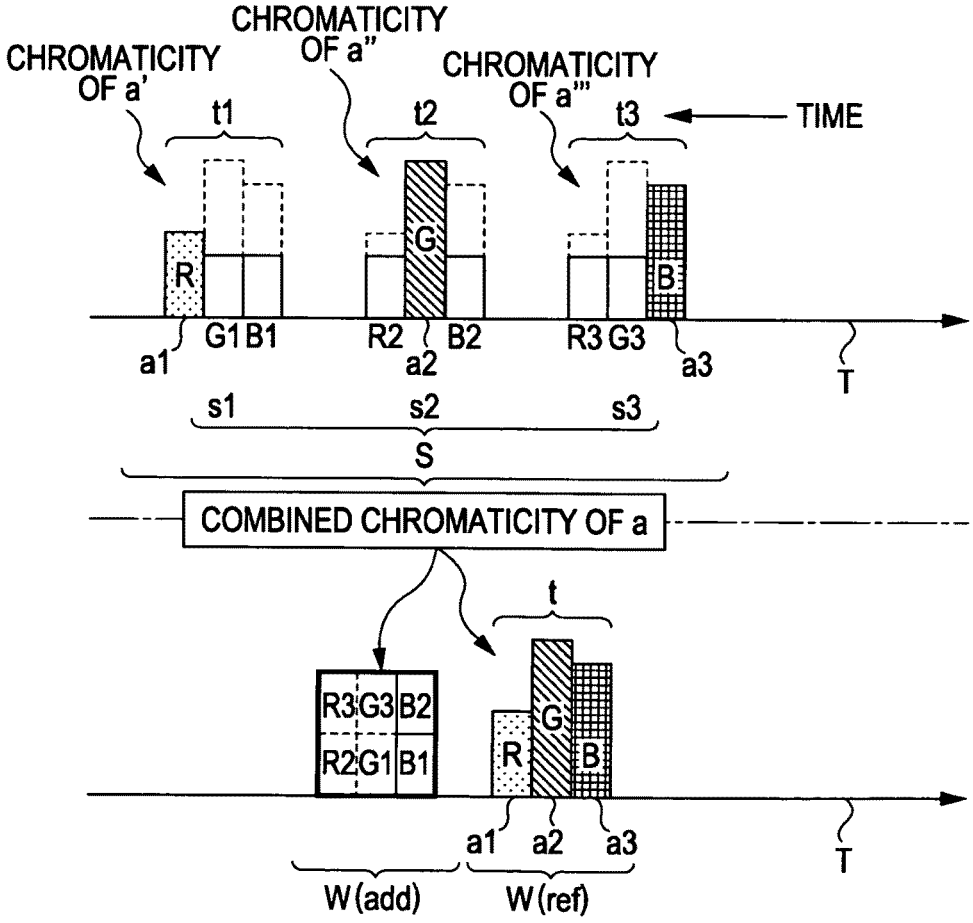
FIG. 13 illustrates a decrease in the purity of the chromaticity at a specific position a on the screen S.

FIG. 13 illustrates a decrease in the purity of the chromaticities at the specific positions a on the screen S. FIG. 13 shows chromaticities at specific positions on the screen when other color is mixed at the same time. Since light of W(add) reaches the entire screen S that lacks a color filter, not only a composite chromaticity at the specific position a but also a chromaticity at the specific position b is also affected and varied.

$$W(ref)+W(\text{add}))=\underset{\substack{\uparrow\\ s1}}{\alpha(aR+b''G1''+c''B1'')}+\underset{\substack{\uparrow\\ s2}}{\alpha(a''R2''+bG+c''B2'')''}+\underset{\substack{\uparrow\\ s3}}{\alpha(a''R3''+b''G3''+cB)} \tag{10}$$

Equation (10) means that unwanted color light G1 and B1, other than R, are lit at time t1, unwanted color light R2 and B2, other than G, are lit at time t2, and unwanted color light R3 and G3, other than B, are lit at time t3. Integration of all the colors (R, G, and B) yields R+R2+R3, G+G1+G3, and B+B1+B2 having excess components. That is, since the components R2+R3, G1+G3, and B1+B2 are additionally mixed into the integrated colors, it is obvious that equation (10)−equation (9)=W(add) is satisfied.

For example, a concept of inserting an additional field having white components into each field screen has been proposed as measures for preventing color breakup in the field sequential system. With such a proposed technology, however, it is extremely difficult to reproduce chromaticity since white is mixed into another field, as described in the related art. Such a technology is thus disadvantageous since unwanted components are lit. The above-noted expression "equation (10)−equation (9)=W(add)" indicates that, when integration is sequentially executed per unit time, the color purity of a high-color-purity portion is reduced by the mixed-white field.

As described above, in practice, since the actual image is a moving image, not a still image, the image has variations in the time-axis direction. For a television system, an image displayed changes for each image frame that is continuously fed and reproduced. Thus, the image has white components that vary in accordance with the displayed image that changes for each image frame. In the above description, one frame is constituted by three fields, i.e., R, G, and B fields.

Since the values of the white difference continuously change, when attention is given to the constituent ratio of the RGB levels in an area defined by m×n pixels in a plane parallel to a screen and the color of the portion is to be reproduced using mixed colors in the time axis direction, ΔW(k, j) (T1) is given for the frame S1. T1 indicates time that is representative of the combination of t1, t2, and t3, and in order to reproduce T1, fields s1, s2, and s3 are provided to yield S1=s11+s12+s13. For a frame S2, ΔW(k, j)(T2) is given. T2 indicates time that is representative of the combination of t1, t2, and t3, and in order to reproduce T2, fields s1, s2, and s3 are provided to yield S2=s21+s22+s23.

For a frame S3, ΔW(k, j)(T3) is given. T3 indicates time that is representative of the combination of t1, t2, and t3, and in order to reproduce T3, fields s1, s2, and s3 are provided to yield S3=s31+s32+s33. For a frame Sn, ΔW(k, j)(Tn) is given. Tn indicates time that is representative of the combination of t1, t2, and t3, and in order to reproduce Tn, fields s1, s2, and s3 are provided to yield Sn=sn1+sn2+sn3. In this manner, unique values obtained from each extracted area defined by m×n pixels in each frame can also be distributed in the time axis direction.

As can be understood from FIG. 11, since three fields are combined together to reproduce one image, three field images are used for a frame at one point in time, and a total of 3n field images continue until time Tn.

(Display in Combination of Time and Space)

Display in a time-and-space combination that is a major feature of the present invention will now be described.

The white difference in the same image plane in a still image in an arbitrary frame has been defined above. Similarly, in this case, a description will be given of an example in which one frame image is separated into n homogenous-color field screens (n is an integer of 3 or greater).

In this case, it is assumed that n is 3 and the fields are an R field, a G field, and a B field with the reference color lights being R, G, and B. However, this is merely one example, and for example, it may be assumed that n is 7, the reference color lights are seven colors, e.g., R, G, B, Ye, Mg, Cy, and W including complementary colors and white color, the fields are an R field, a G field, a B field, an Ye field, a Mg field, a Cy field, and a W field. Even in such a case, the concept is the same.

A typical concept of a television system generally called the field sequential system is that, for example, images having brightnesses of color components of the homogeneous R, G, and B colors are sequentially displayed at times t1, t2, and t3, respectively, so as to cause the colors thereof to be mixed on the retina. Comparison of the values of the combination of color lights of the images s1, s2, and s3 separated at times t1, t2, and t3 along the time axis with W(ref) makes it possible to define the constituent ratio of image RGB levels corresponding to the times t1, t2, and t3.

Since this concept is utilized to perform color discrimination in only the time direction, the color filter, which is a spatial color-discrimination functional element, can be eliminated as described above. The display device 10 according to the embodiment of the present invention includes the backlight (the light source section 30) divided into blocks (the partial light-emitting areas 32) that are capable of selectively emitting color light in a space direction on the same field screen and also the image computation device (the image processing section 46) that is capable of executing correction processing for performing superimposition at an arbitrary position of the backlight. Thus, the present invention can provide a novel technology that performs color image reproduction (color image display) with behavior that is different from that in the related art.

In the same manner described above, it is now assumed that, in a plane parallel to a still-image display screen in an arbitrary frame, the color of an area defined by m×n pixels has a chromaticity value expressed by W(k, j) which is expressed by equation (2) described above.

As described above, the field sequence concept is based on the premise that, in practice, the chromaticity value W(k, j), which is a combination (integration or sum) of homogeneous-color screens s1, s2, and s3 for the respective R, G, and B in the time-axis direction, is expressed by equation (9) described above.

According to the present invention, all color light can be expressed in each field. Thus, based on the approach shown in equation (3), the right-hand side in equation (8) can be converted, through separation of the reference white components W(ref) into an equation of summation with the white reference ΔW(ref), where αc is assumed to be the smallest coefficient.

The coefficients a, b, and c of R, G, and B have a relationship of a>b>c, as described above. Since the illumination levels of the reference white W(ref) are made to match the coefficient c, the term for B disappears. From equation (3), equation (8) is given by:

$$W(k,j)=\alpha[cW(ref)+(a-c)R+(b-c)G] \tag{11}$$

Thus, the reference white W(ref) is given as:

$$W(ref)=\underset{\substack{\uparrow\\ t1\ s1}}{\alpha(cR+cG+cB)}+\underset{\substack{\uparrow\\ t2\ s2}}{\alpha[(a-c)R]}+\underset{\substack{\uparrow\\ t3\ s3}}{\alpha[(b-c)G]} \tag{12}$$

The physical meanings expressed by equation (12) are that a monochrome screen s1 corresponding to an RGB illumination ratio of the reference white W(ref) is displayed at time t1, an image s2 representing a red illumination difference is displayed at time t2, and a screen s3 representing a green illumination difference is displayed at time t3. Equation (12) also means that the screens s1, s2, and s3 are integrated and combined together on the retina in the time axis direction (as T1=t1+t2+t3) for display as a composite screen S1.

$$W(ref)=\underset{\substack{\uparrow\\ t1\ s1}}{(1/3)\alpha(cR+cG+cB)}+\underset{\substack{\uparrow\\ t2\ s2}}{(1/3)\alpha(cR+cG+cB)+\alpha[(a-c)R]}+\underset{\substack{\uparrow\\ t3\ s3}}{(1/3)\alpha(cR+cG+cB)+\alpha[(b-c)G]} \tag{13}$$

The physical meanings expressed by equation (13) are that one third of the amount of reference white light of a monochrome screen corresponding an RGB illumination ratio of the reference white W(ref) is displayed (as s1) at time t1, one third of the amount of reference white light together with a red-illumination difference image is displayed (as s2) at time t2, and one third of the amount of reference white light together with a green-illumination difference image is displayed (as s3) at time t3. Equation (13) also means that the screens s1, s2, and s3 are displayed as a composite screen S1 (=s1+s2+s3).

The coefficients a, b, and c of R, G, and B have a relationship of a>b>c, as described above, and since the illumination levels of the reference white W(ref) are made to match the coefficient c, the term for B disappears. The three terms may be regarded as being equivalent to the states at times t1, t2, and t3 sequentially from the left.

As expressed by equation (9), the existing concept of the field sequential system is aimed to perform color mixing for mixing colors only in the time axis direction without using mixed colors in the space and without use of a color filter. Thus, the exiting concept has one important premise that, at each point of times s1, s2, and s3, the color light components other than one color are 0 in order to correctly represent a mixing ratio and to reproduce color light.

In the present invention, what are expressed by equations (12) and (13) can be realized by spatial division of the light source 30, which serves as a backlight. The above-described concept will be described in more detail in conjunction with an example of backlight illumination of an arbitrary one block (the partial light-emitting area 32) and with reference to the accompanying drawings.

White Allocation

Figure 14A:
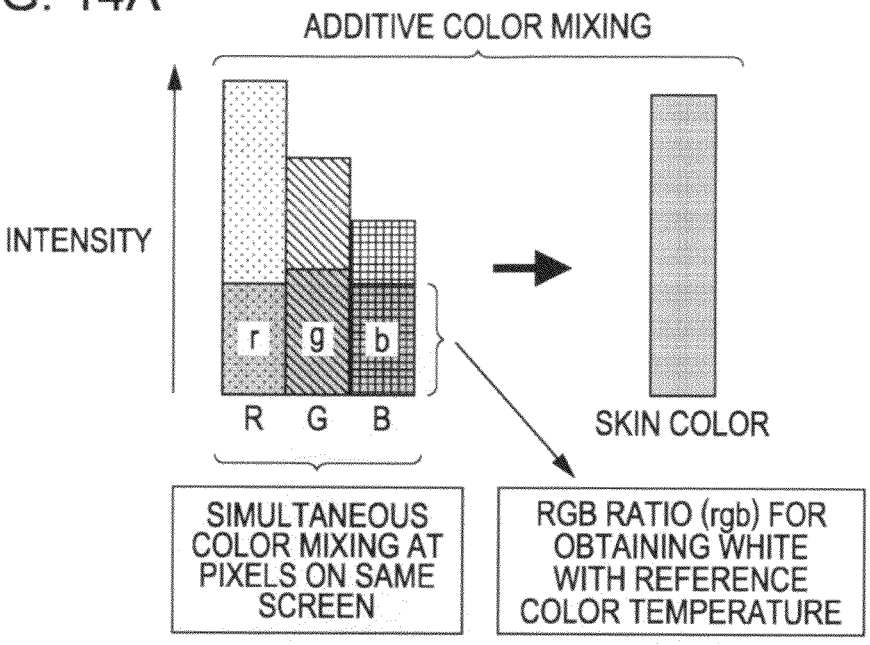
FIGS. 14A and 14B illustrate additive color mixing for obtaining skin color.
Figure 14B:
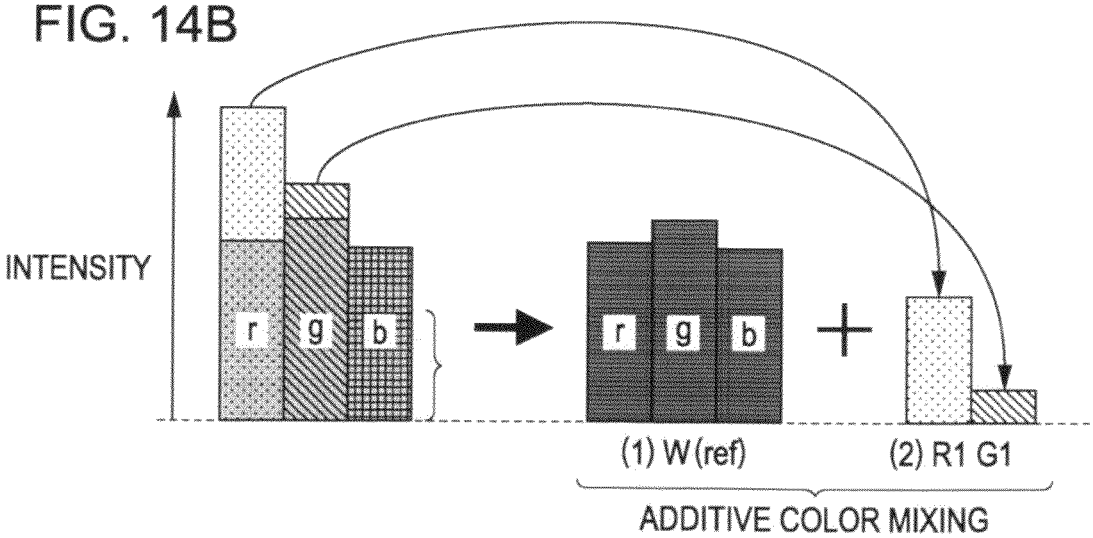

As shown in FIG. 14A, simultaneously subjecting R, G, and B colors having predetermined intensities to additive color mixing on the same screen can provide a skin color. In FIG. 14A, r, g, and b indicate an RGB ratio for obtaining white with a reference color temperature. As shown in FIG. 14B, skin color obtained by the additive color mixing is expressed by a combination of illumination of (1) the reference white W(ref) and illumination of (2) excess components R1 and G1, with the level ratio of the white balance being made to match the lowest illumination level (intensity).

Figure 15:
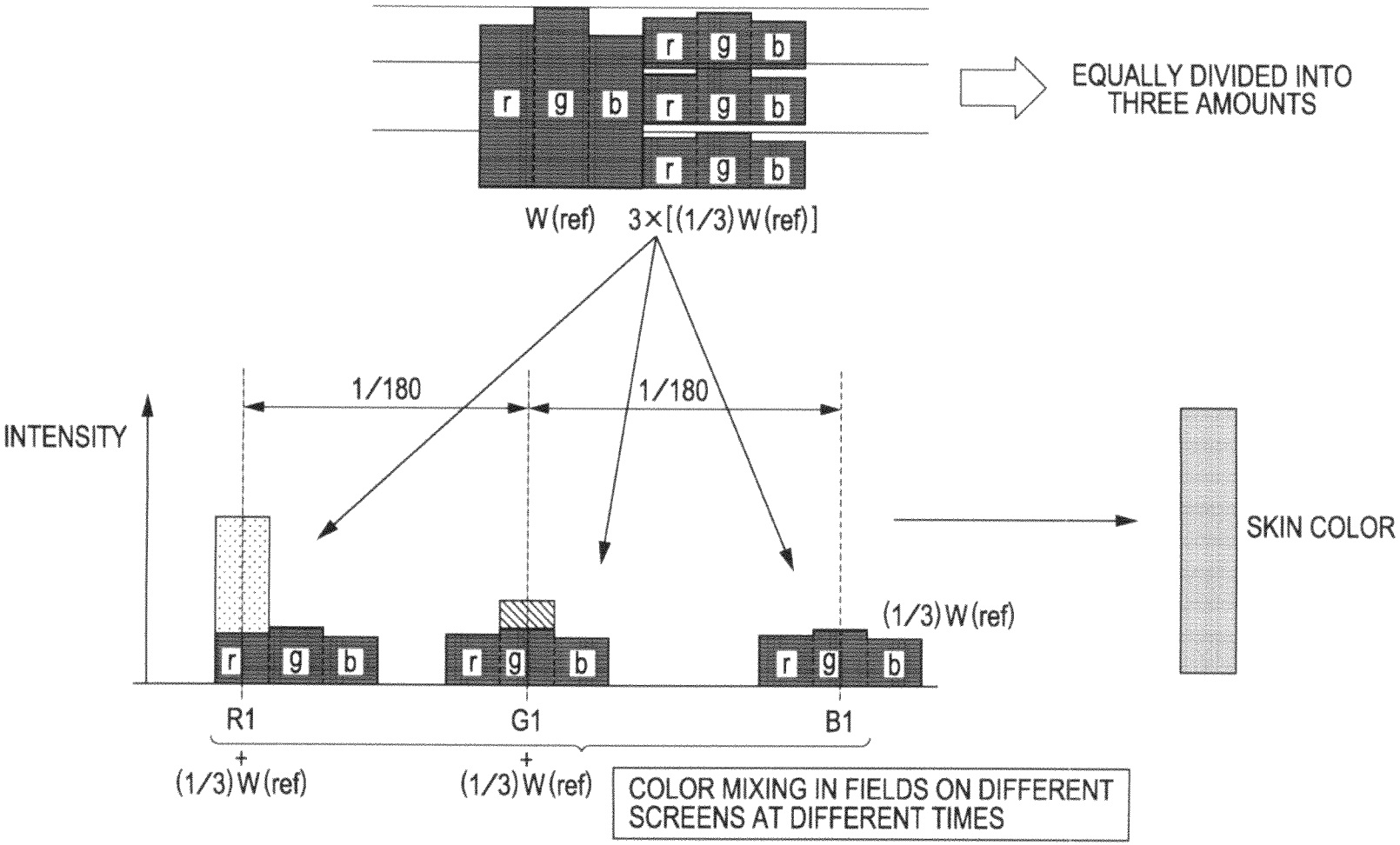
FIG. 15 illustrates white allocation.

Accordingly, as shown in FIG. 15, in the present embodiment, the reference white W(ref) is equally divided into three amounts for three fields, i.e., an R field, a G field, and a B field, and the divided amounts are equally allocated to the fields in the time axis direction. In this case, the green image position may require processing for combination with an image having one-third the illumination. Green and red other than blue are lit by small amounts to provide a monochrome screen.

Figure 16:
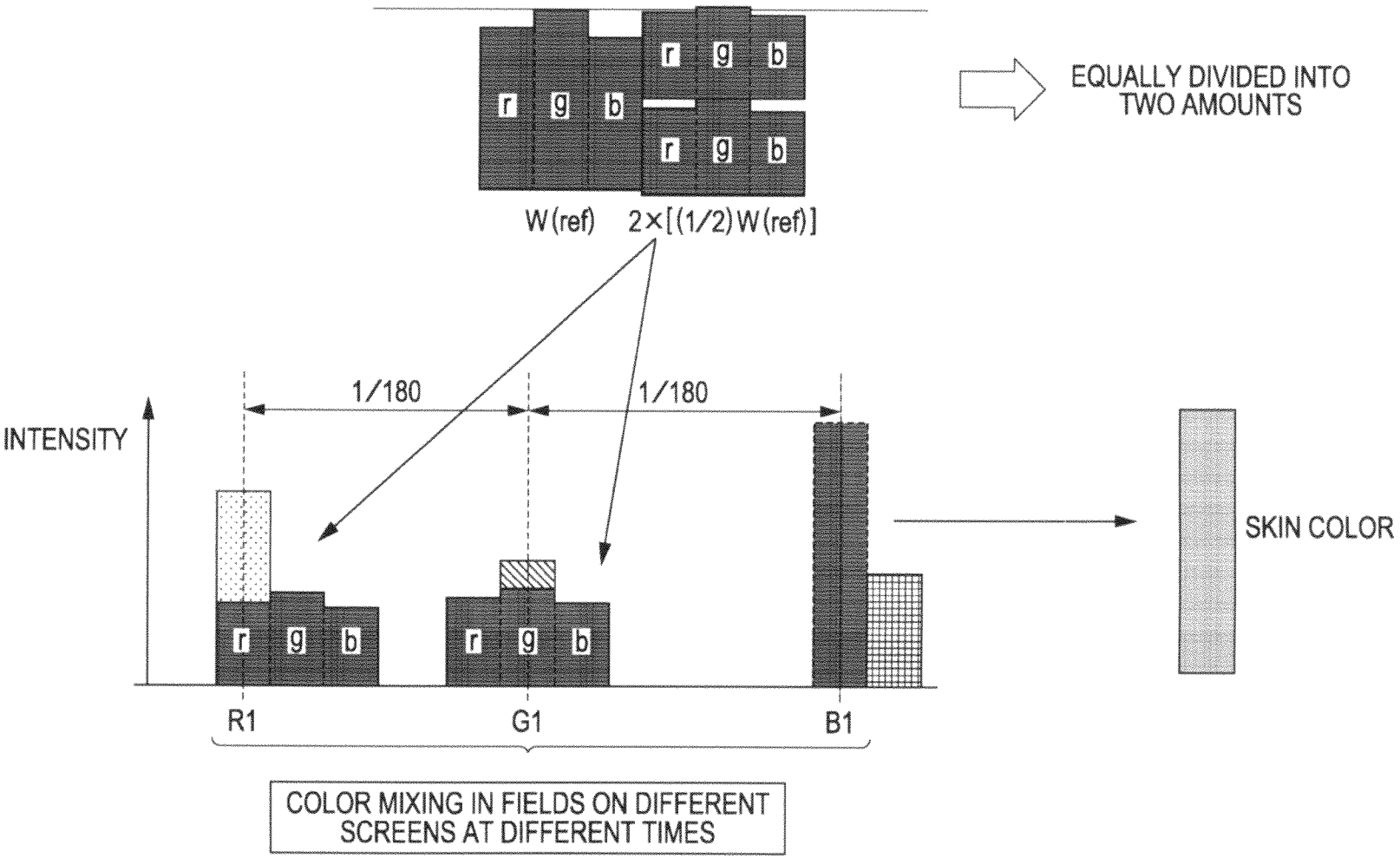
FIG. 16 illustrates a case in which, during white allocation, the blue primary color is displayed immediately next to skin color.

If the blue primary color is displayed at a position immediately next to a skin color, it is difficult for the blue screen to share a load for lighting other colors, in order to maintain the blue color purity. In such a case, the blue screen is helped by screens having other colors. Specifically, as shown in FIG. 16, the reference white W(ref) is equally divided into two amounts, which are equally allocated to the red and green fields. In this case, no white is lit in the neighborhood of the blue primary color.

Complementary Color Allocation

Figure 17A:
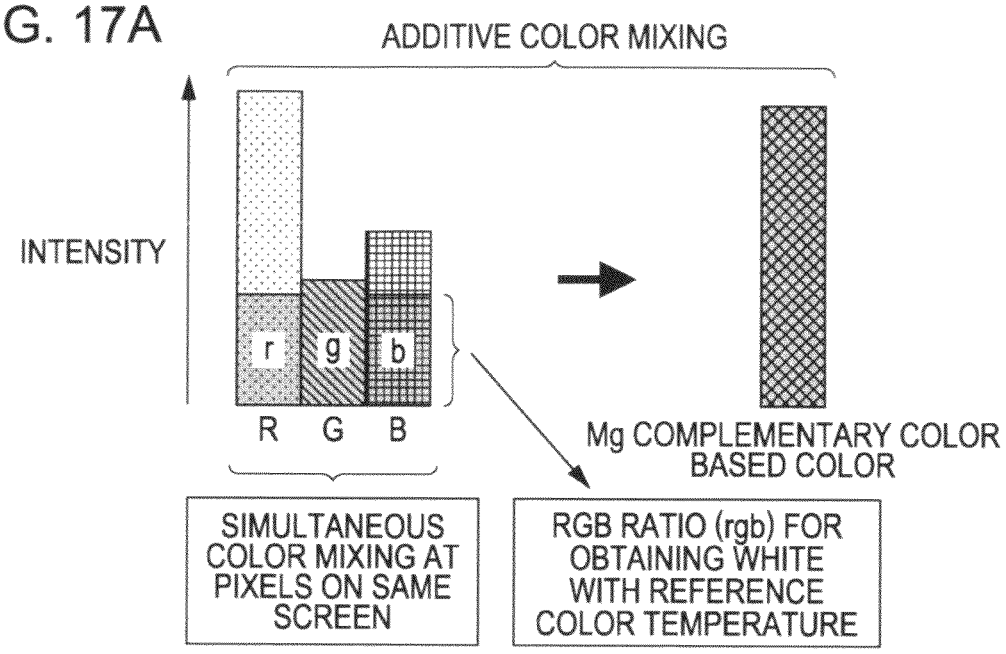
FIGS. 17A and 17B illustrate additive color mixing for obtaining a magenta-type complementary-color-based color.
Figure 17B:
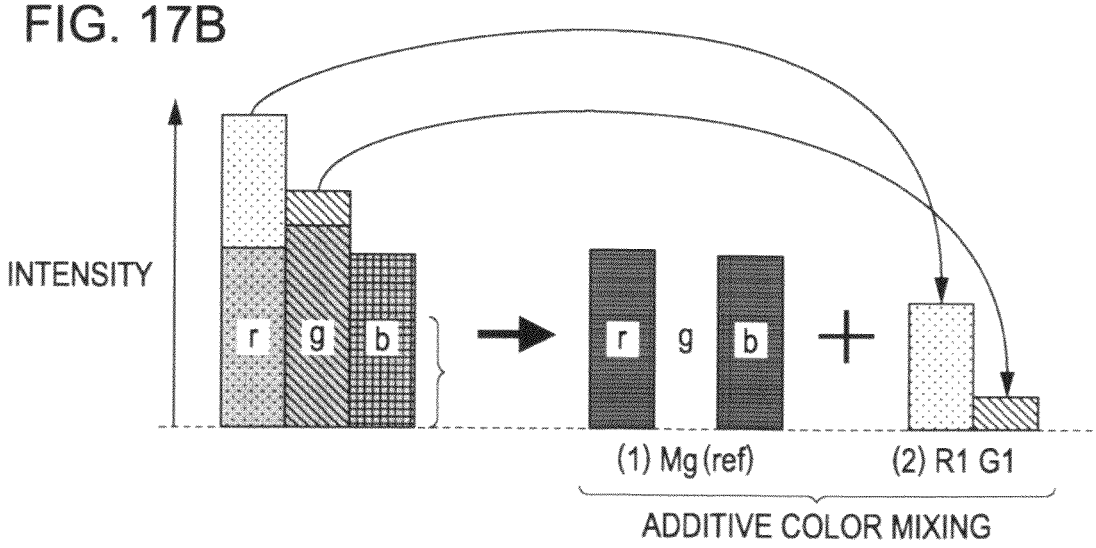

As shown in FIG. 17A, simultaneously subjecting R and B colors having predetermined intensities to additive color mixing on the same screen can provide a magenta (Mg) type complementary-color based color. In FIG. 17A, r, g, and b indicate an RGB ratio for obtaining white with a reference color temperature. As shown in FIG. 17B, the magenta-type complementary-color-based color obtained by the additive color mixing is expressed by a combination of illumination of (1) the reference complementary color Mg(ref) and illumination of (2) excess components R1 and G1, with the level ratio of the white balance being made to match the lowest illumination level.

Figure 18:
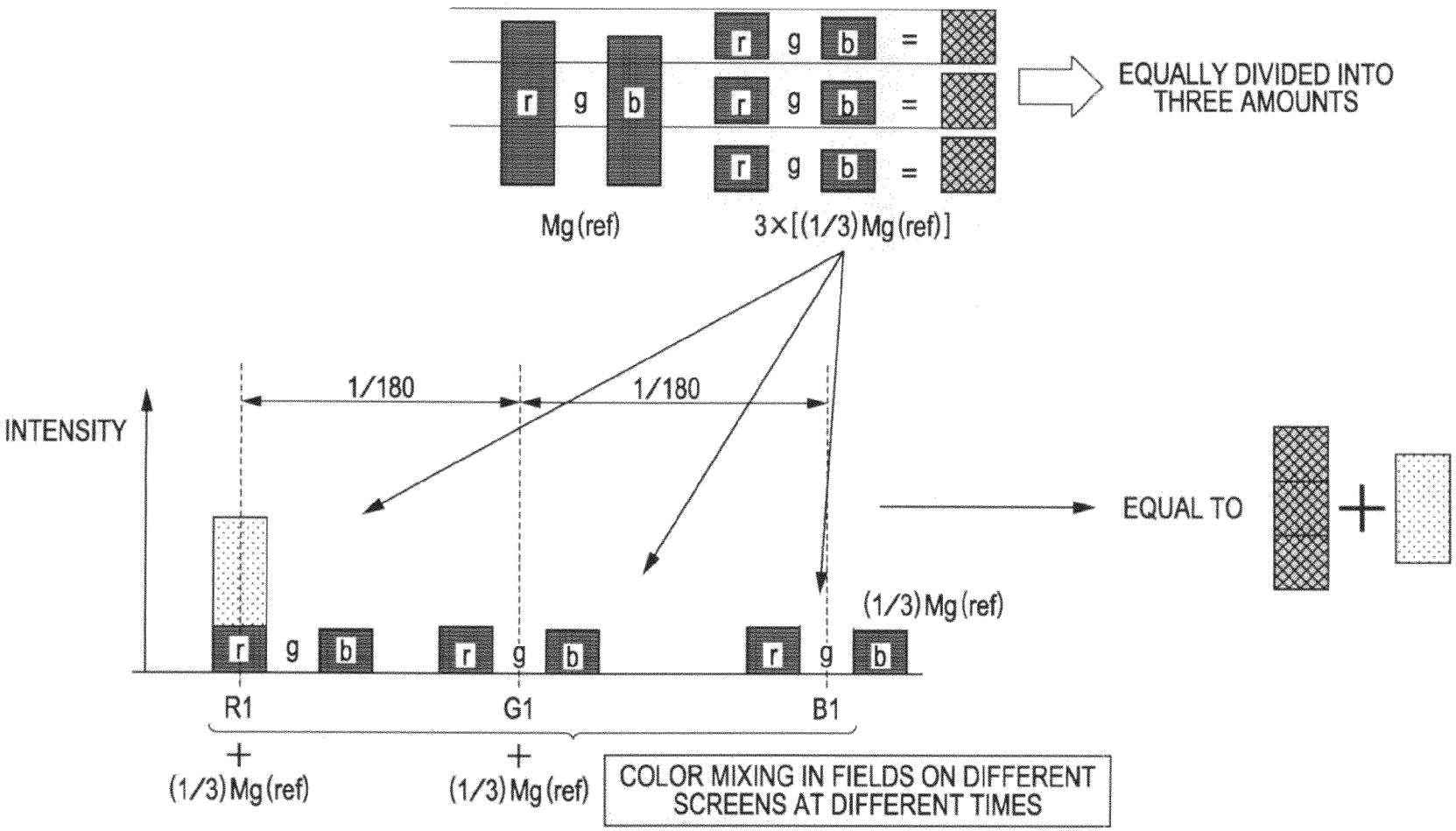
FIG. 18 illustrates complementary-color allocation.

Accordingly, as shown in FIG. 18, in the present embodiment, the reference complementary color Mg(ref) is equally divided into three amounts for the three fields, that is, the R field, the G field, and the B field, and the divided amounts are equally allocated to the fields in the time axis direction.

Figure 19:
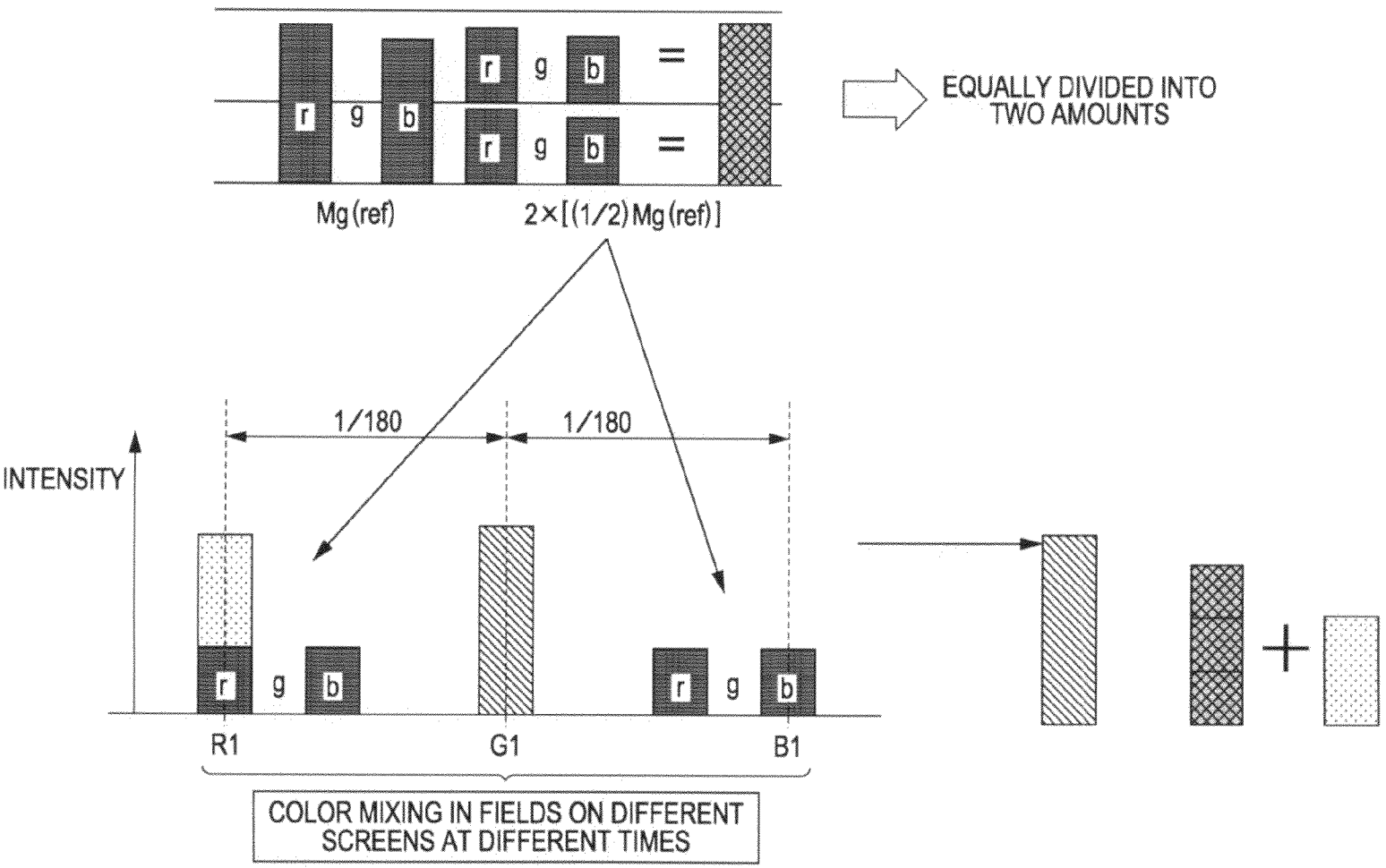
FIG. 19 illustrates a case in which, during complementary-color allocation, the blue primary color is displayed immediately next to skin color.

If a color that is displayed at a position immediately next to a complementary-color-based color is a primary color (in this example, green) that is not included in the complementary color, it is difficult for the green screen to share a load for lighting other colors, in order to maintain the green color purity. In such a case, the green screen is helped by screens having other colors. Specifically, as shown in FIG. 19, the reference complementary color Mg(ref) is equally divided into two amounts, which are equally allocated to the red and blue fields. In this case, no white is lit in the neighborhood of the green primary color.

Complementary Color Allocation & White Allocation

Figures 20A, 20B, 20C:
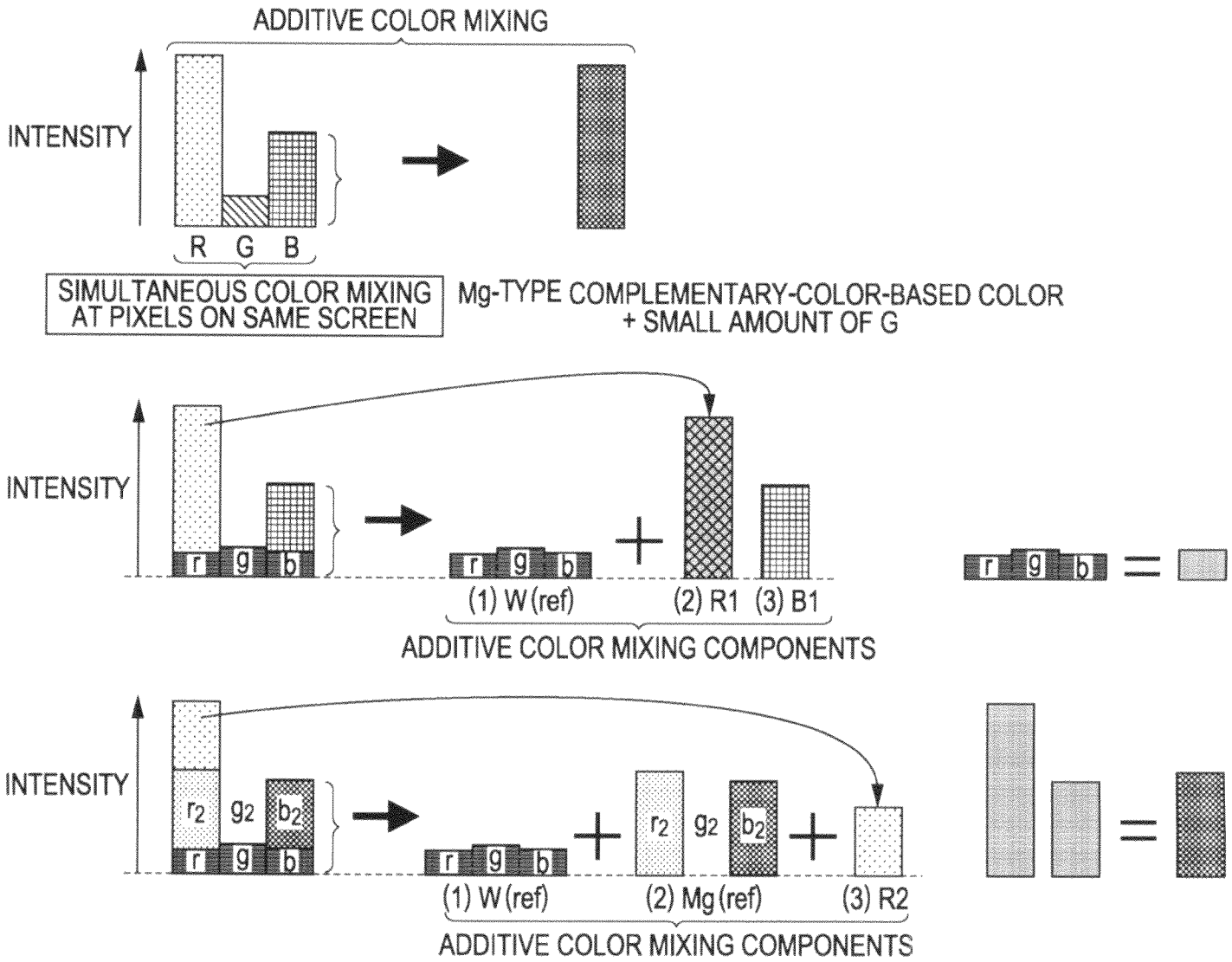
FIGS. 20A to 20C illustrate additive color mixing for obtaining a magenta-type complementary-color-based color and a small amount of G.

As shown in FIG. 20A, when R, G, and B colors having predetermined intensities are subjected additive color mixing on the same screen, a color having a mixture of a magenta (Mg) type complementary-color-based color and a small amount of green is obtained. In FIG. 20B, r, g, and b indicate an RGB ratio for obtaining white with a reference color temperature. The level of G is extremely low, but is not "0".

As shown in FIG. 20B, as a second stage, the magenta-type complementary-color-based color and the small amount of G, which are obtained by the additive color mixing, are expressed by a combination of illumination of (1) the reference white W(ref) and illumination of (2) excess components R1 and B1, with the level ratio of the white balance being made to match the lowest illumination level. In a second stage, as shown in FIG. 20C, since two colors remain as a result of removal of the illumination components of (1) the reference white W(ref), the illumination components of (2) the excess components R1 and B1 are expressed by a combination of the reference complementary color Mg(ref) and another excess color.

Figure 21:
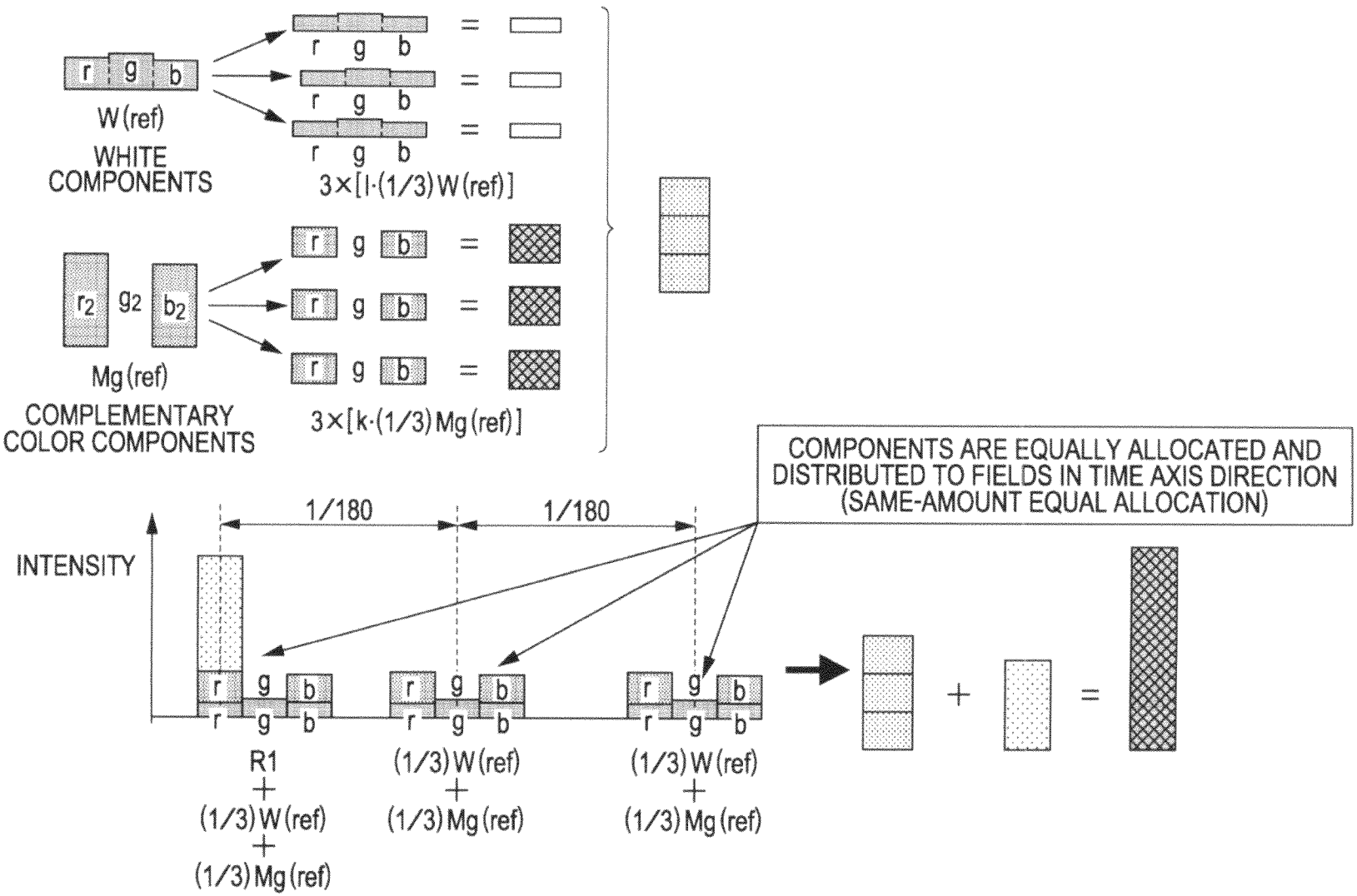
FIG. 21 illustrates complementary-color allocation and white allocation.

Thus, as shown in FIG. 21, in the present embodiment, both the white components and the complementary-color components are equally divided into three amounts, which are equally allocated and distributed to the fields in the time axis direction. In this case, the green and blue image positions may require processing for combination with an image having one-third of the magenta components. As a result of the processing, red is lit by a small amount to provide a color screen.

Figure 22:
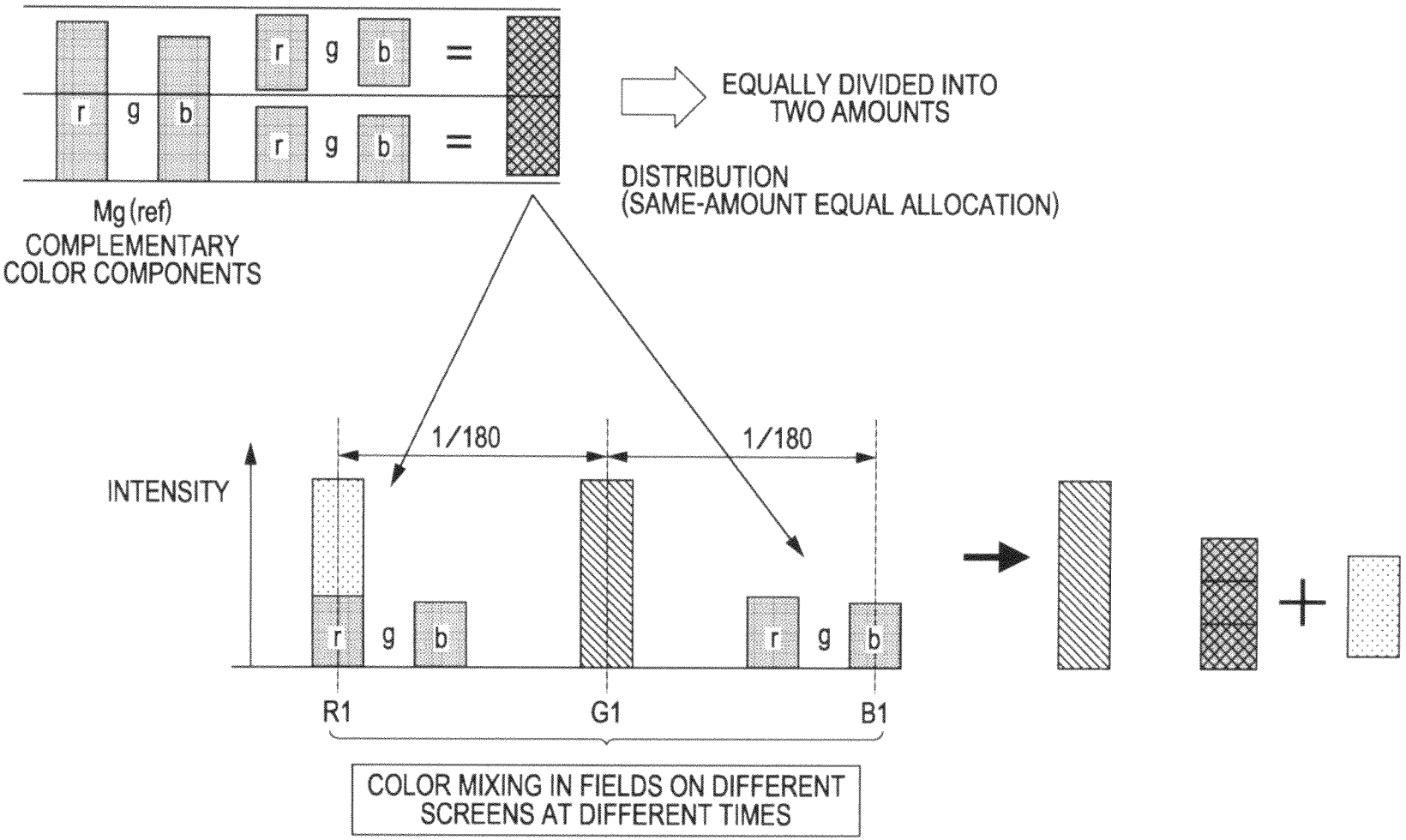
FIG. 22 illustrates a case in which, during complementary-color allocation and white allocation, the blue primary color is displayed immediately next to skin color.

If a color displayed at a position immediately next to a complementary-color-based color is a primary color (in this example, green) that is not included in the complementary color, it is difficult for the green screen to share a load for lighting other colors, in order to maintain the green color purity. In such a case, the green screen is helped by screens having other colors. Specifically, as shown in FIG. 22, the reference complementary color Mg(ref) is equally divided into two amounts, which are equally allocated to the red and blue fields. In this case, no white is lit in the neighborhood of the green primary color.

(Operation for Minimizing Color Breakup)

Minimization of color breakup can be achieved by processing mixed colors, other than the primary colors, in an image space at the same time to the extent possible. To this end, according to the present invention, spatial division is performed using the light source section (backlight) 30. The light source section 30, however, has a much smaller number of divided blocks than the number of pixels of the liquid crystal panel 20, and thus has a low resolution. Since the number of pixels is small, the direct use of the light source section 30 does provide a sufficient display quality for displays.

The color lights are assumed to satisfy a=b=c. In this case, based on the typical field sequential concept expressed by equation (9) noted above, the R, G, and B color lights are allocated and displayed in the fields s1, s2, and s3. With such a method, in order to represent white in monochrome color, white is divided into the primary colors in the time axis direction. Thus, as described above, the phenomenon of color breakup, which is a visually displeasing effect, occurs.

From the equations, the integration (the sum) of the term of t1 s1, the term of t2 s2, and the term of t3 s3 yields W(k, j)=αa(R+G+B) (for a=b=c). However, because of actual visual properties, it is difficult to perceive the image as represented by W(k, j)=αa(R+G+B), unless s1, s2, and s3 are switched at a considerably high speed.

However, as is typically known, flicker is perceived during viewing of a monochrome television screen, unless the image is refreshed at a high rate, and we empirically know that the phenomenon is merely a continuation of monochrome color into which colors are already mixed and thus no color breakup occurs. Therefore, we also know that equation (9) is equivalent to equation (14).

$$W(k,\ j) = \underset{\substack{\uparrow \\ t1\ s1}}{\frac{(1/3)\alpha(aR + bG + cB)}{}} + \underset{\substack{\uparrow \\ t2\ s2}}{\frac{(1/3)\alpha(aR + bG + cB)}{}} + \underset{\substack{\uparrow \\ t3\ s3}}{\frac{(1/3)\alpha(aR + bG + cB)}{}} \tag{14}$$

The right-hand side in equation (14) shows that white images having one third of the chromaticity value (k, j) are displayed at times t1, t2, and t3. Although color breakup occurs in equation (9), no color breakup occurs in equation (14). The difference is caused by whether or not the images having the primary colors are time-sequential, and it is thus easily presumable that reducing the degree of the time sequence causes the state to become closer to that given by equation (14).

Thus, it is also presumable that separating, as W(ref) components used for displaying white, the amounts of RGB lighting from color light obtained by lighting RGB and allocating the separated amounts at times t1, t2, and t3 makes it possible to cause the state closer to that given by equation (14).

The concept of minimizing color breakup will now be defined. When the degree of white of a portion being displayed is high (i.e., the color purity is low) and inter-field primary-color correlation of the portion is significantly low, the amount of color breakup increases. The white difference ΔW(ref) has been defined above with respect to the physical quantity that represents the concept of "a high degree of white (a low purity)" of a portion being displayed. A portion at which the white difference ΔW(ref) is large is dark in color, and does not cause color breakup because of its low mixed-color rate even when the inter-field correlation is low. On the other hand, it can be said that a portion at which the white difference ΔW(ref) is small causes color breakup unless the inter-field correlation is increased.

Increasing the inter-field correlation means maximizing a state of allocating the color components to the fields for averaging. Thus, a coefficient indicating the degree of difficultness of color-break occurrence can be determined using the inter-field correlation. A proportionality coefficient β for the degree of difficultness may be set as a function value that has its largest value when the following condition is satisfied:

$\beta \propto G$ (the white difference is small and the color inter-frame correlation is high).

Whether or the inter-field correlation is high or low can be determined and set by averaging the values of some continuous fields in an arbitrary image area, obtaining a difference between the average value and the individual field values, and using the amount of the difference. More specifically, when the amount of difference is larger than or equal to a predetermined amount, it can be determined that the correlation is low, and when the amount of difference is lower than the predetermined amount, it can be determined that the correlation is high.

This approach is based on the idea that, when the field sequential system is employed, it is naturally that the amount of color breakup increases, since a portion at which the primary-color color purity is low is purposely used for processing for combination, in the time axis direction, with the field images that have low inter-field correlations.

Accordingly, the sequential inter-field correlation is predetermined from portions at which the primary-color color purities are low, the color is field-sequenced, and the reference white components are allocated to the fields. More specifically, the allocation ratio is set so that the inter-field correlation is maximized and the reference-white components are allocated to the fields so as to maintain the continuity of the amount of light. This can prevent occurrence of luminance ripple.

EXAMPLE

A specific example for embodying the above-described concepts of the present invention will be described next. Drive control for the liquid crystal panel 20 and the light source section (backlight) 30 according to this example is executed under the control of the display control section 40, particularly, the computational algorithm circuit 41, shown in FIG. 1.

The computational algorithm circuit 41 has at least three functions. A first function is to determine the degree of white or the degree of complementary color of the light sources 31 on the basis of the amounts of lighting of individual illumination colors emitted by the light sources 31 and determined by signals of a color image to be displayed. A second function is to set, on the basis of a result of the determination, white components or complementary-color components of a color that is defined by the mixing ratio of multiple illumination colors. A third function is to allocate the set color components or complementary-color components to the fields. These functions are executed by various types of processing described below.

Figure 23:
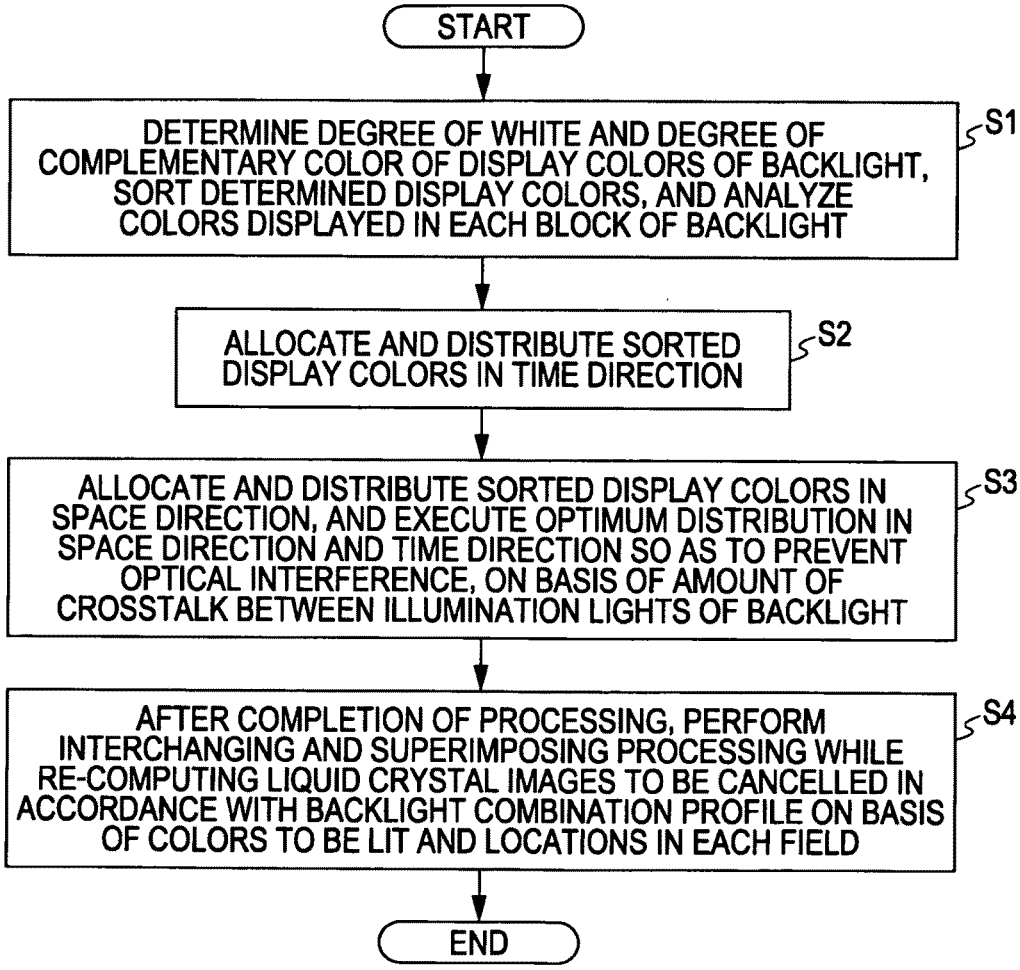
FIG. 23 is a flowchart showing a processing procedure for spatiotemporal display for n-field combination at an on-screen position (x, y)

FIG. 23 is a flowchart showing a processing procedure for spatiotemporal display for n field combination at an on-screen position (x, y). In this flowchart, processing in steps S1 to S3 corresponds to control performed on the light source section 30 (hereinafter may be referred to as "backlight") and processing in step S4 corresponds to control performed on the liquid crystal panel 20.

First, in step S1, processing is performed to determine the degree of white and the degree of complementary color of the display colors of the backlight (the illumination color of the light source section 30) and to sort the determined display colors. The degree of white indicates to what degree the display color of the backlight white and the degree of complementary color indicates to what degree the display color of the backlight contains complementary color. Further, analysis is also performed on colors displayed in each block (the partial light-emitting area) of the backlight. In step S2, processing is performed to allocate and distribute the display colors, sorted in step S1, in a time direction.

In step S3, processing is performed to allocate and distribute the display colors, sorted in step S1, in a space direction. In this case, on the basis of the amount of crosstalk between the illumination lights of the backlight, processing is performed to execute optimum distribution in the space direction and the time direction so as to prevent optical interference. Specific processing in steps S1 to S3 is described below in more detail.

In step S4, interchanging and superimposing processing is performed while re-computing a liquid crystal image to be cancelled, in accordance with a backlight combination profile on the basis of colors to be lit and locations in each field. That is, after all the backlight color distribution processing is completed in steps S1 to S3, processing is performed to display a monochrome liquid-crystal image that is to be subjected to reverse correction for obtaining a desired color image as a final composite frame image S1.

(Example of Determination of Degree of White/Degree of Complementary Color of Backlight Display Color, and Example of Allocation)

Figure 24:
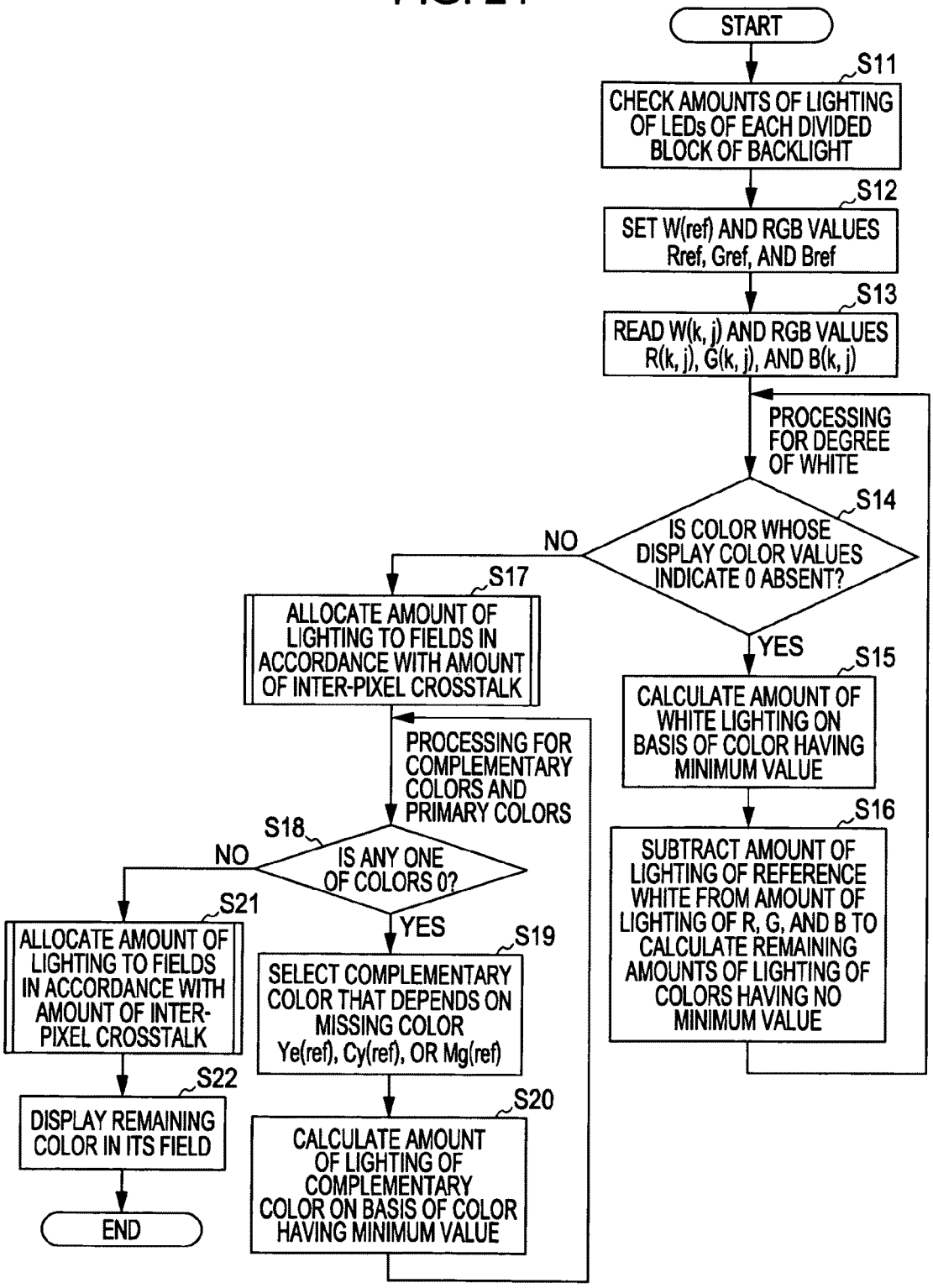
FIG. 24 is a flowchart showing one example of processing for determining the degree of white and the degree of complementary color of a backlight display color and processing for allocation.

FIG. 24 is a flowchart showing one example of specific processing in step S1, i.e., one example of processing for determining the degree of white and the degree of complementary color of the backlight display colors and for allocating the display colors.

First, in step S11, the amounts of lighting of the red LED 31R, the green LED 31G, and the blue LED 31B are checked with respect to the R, G, and B images of each divided block of the backlight. In this case, the amounts of lighting are pre-stored in the memories 44R, 44G, and 44B through resolution/reduction corresponding to the number of divided blocks of the light source section 30 and control of the amounts of lighting of the light sources 31, the resolution reduction and the control being performed by the resolution-reduction and lighting-amount-control sections 43R, 43G, and 43B (shown in FIG. 1) on the basis of R, G, and B image signals.

ext, in step S12, white-balance setting values, i.e., the reference white W(ref), and RGB values are set on the basis of the amounts of lighting of the LEDs 31R, 31G, and 31B. The term "white-balance setting values" refer to values preset for each display device. Subsequently, in step S13, display color values of the liquid crystal panel 20, i.e., the chromaticity values W(k, j) and RGB values of a display image, are read.

Subsequently, in step S14, a determination is made as to whether or not a color whose display color values of the liquid crystal panel 20 indicate 0 is absent. When any color whose display color values indicate 0 is absent, the process proceeds to step S15 in which the amount of white lighting is calculated on the basis of a color having a minimum value. Thereafter, in step S16, the amounts of lighting of the reference white are subtracted from the amounts of lighting of R, G and B to calculate remaining amounts of lighting of colors having no minimum value. The processing in steps S15 and S16 is processing for the degree of white.

In step S15, processing is performed to determine a color having the minimum value (on the basis of |Rref-R(k,j)|, |Gref-G(k,j)|, or |Bref-B(k,j)|) when any of colors represented by the display color values are set so that they do not exceed the white balance setting values.

When it is determined in step S14 that a color whose display color values indicate 0 is present, the process proceeds to step S17 in which the amount of lighting is allocated to the fields in accordance with the amount of inter-pixel crosstalk. Specific processing in step S17 is described below in more detail.

Next, in step S18, a determination is made as to whether or not the value of any one of the colors is 0. When the value of any one of the colors is 0, the process proceeds to step S19 in which a complementary color that depends on the missing color is selected. Subsequently, in step S20, the amount of lighting of the complementary color is calculated on the basis of the color having a minimum value. The processing in steps S19 and S20 is processing for complementary colors and primary colors.

Figure 26:
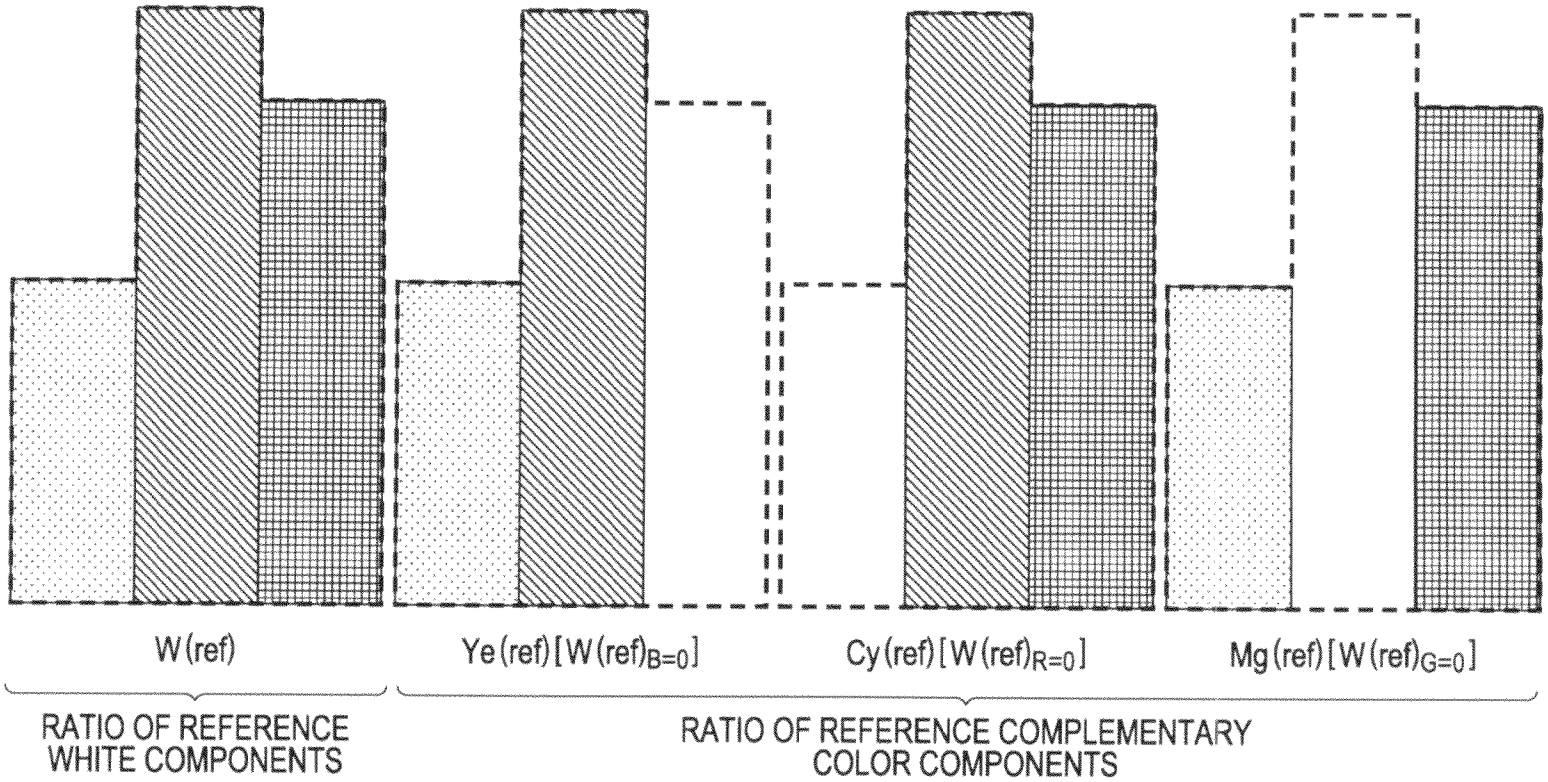
FIG. 26 shows reference colors during complementary-color display.

The processing in step S19 is specifically described with reference to FIG. 26. Since a color that lacks a certain homogeneous-color component (i.e., the value is 0) generally cannot be expressed by a sum of the reference white and a difference therefrom, the allocation ratio is determined assuming that the missing color has been initially absent. During lighting, a complementary color Mg with G being extinguished is assumed to be a reference color during display of a complementary color (see FIG. 26). This scheme can prevent color breakup during lighting.

The amount of lighting is also changed and separated so that the shortage (a-αc) is lit. In the equation, αc is replaced with k, and the resulting equation is for a special case corresponding to a case of k=0 for k·W(ref). In particular, for the complementary colors Ye, Cy, and Mg, k·Ye(ref), k·Cy(ref), and k·Mg(ref) have their maximum values, respectively (see FIG. 26).

Figure 25:
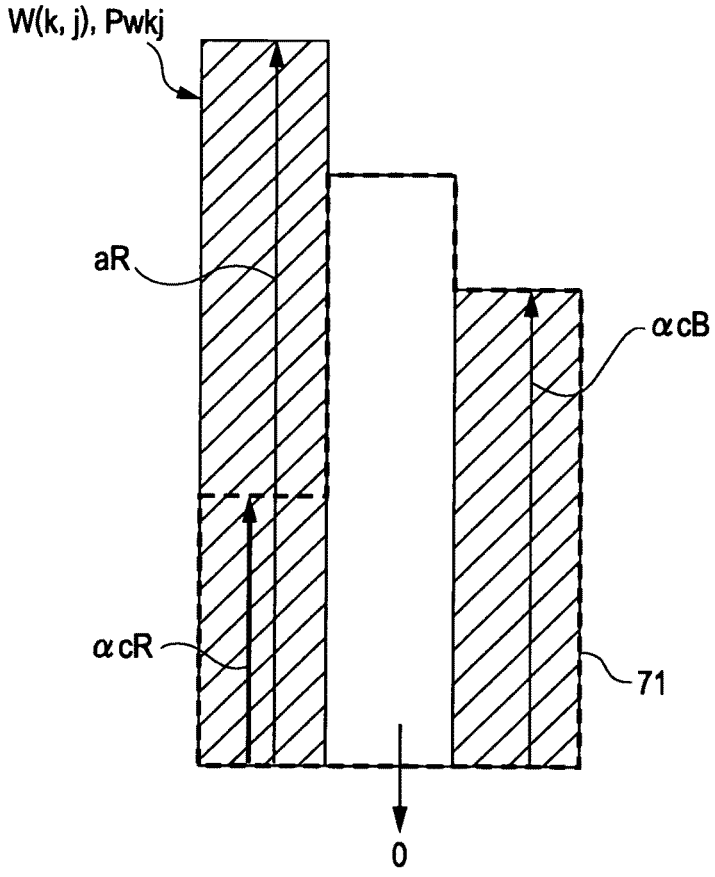
FIG. 25 illustrates a case in which a complementary color that depends on a missing color is selected.

In this case, the remaining difference hatched in FIG. 25 is also regarded as excess color-intensity components that deviate from the reference complementary color. Although G is 0 based on the premise that color reproduction is performed under a correct-white-balance environment in which the ratio of lighting of colors is maintained, the magnitude relationship between R and B can be defined in the ratio relationships of R, G, and B for constituting white.

When it is determined in step S18 that the value of any one of the colors is not 0, the process proceeds to step S21 in which the amount of lighting is allocated to the fields in accordance with the amount of inter-pixel crosstalk. Specific processing in step S21 is described below in more detail.

When it is determined in step S18 that any one of the colors is not 0, that is, when two of the colors are 0, the processing proceeds to step S22. In step S22, the remaining color is displayed in its field, thereby ending the series of processing for determining the degree of white and the degree of complementary color of the display colors of the backlight and for sorting the display colors.

<White Spatiotemporal Processing>

Figure 27:
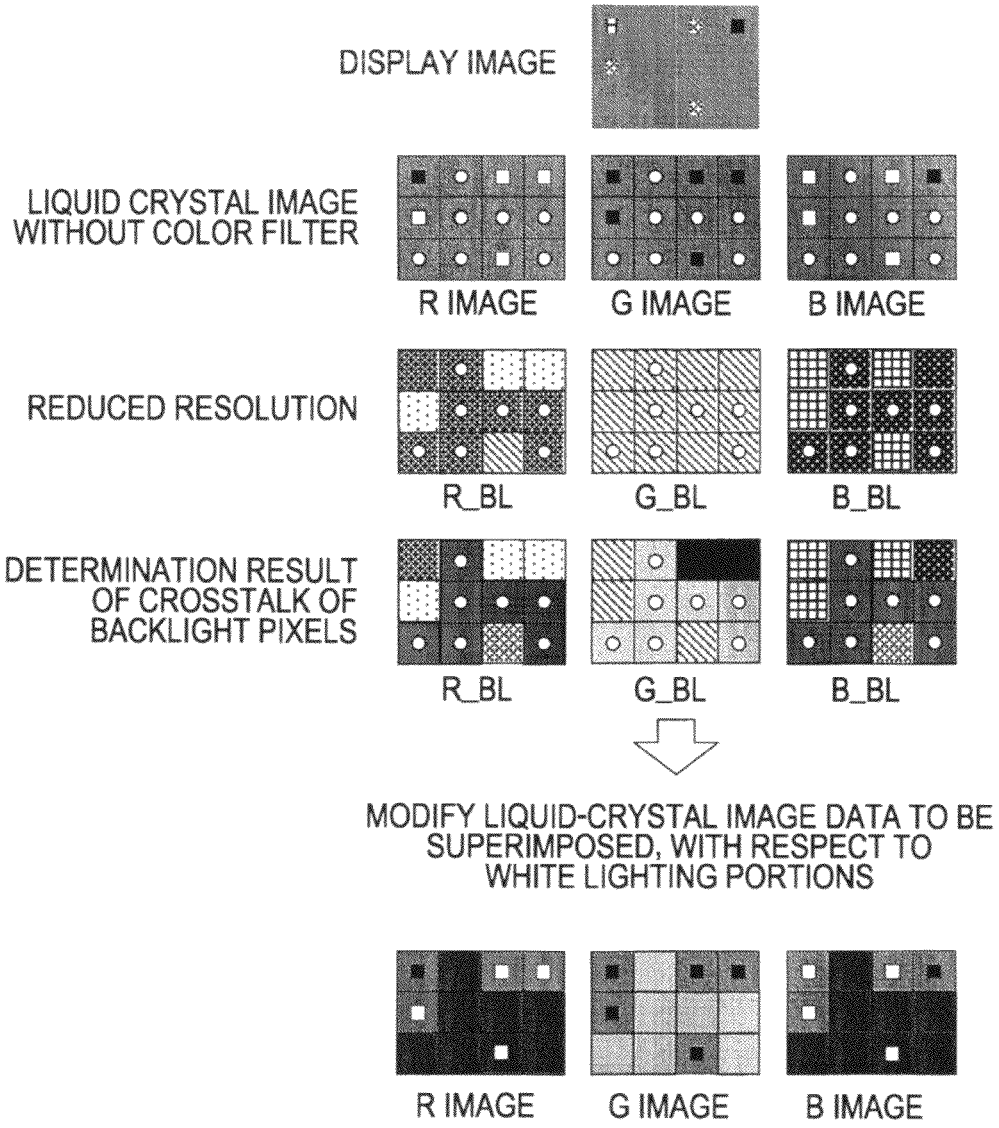
FIG. 27 illustrates one example of spatiotemporal processing for white.
Figure 28:
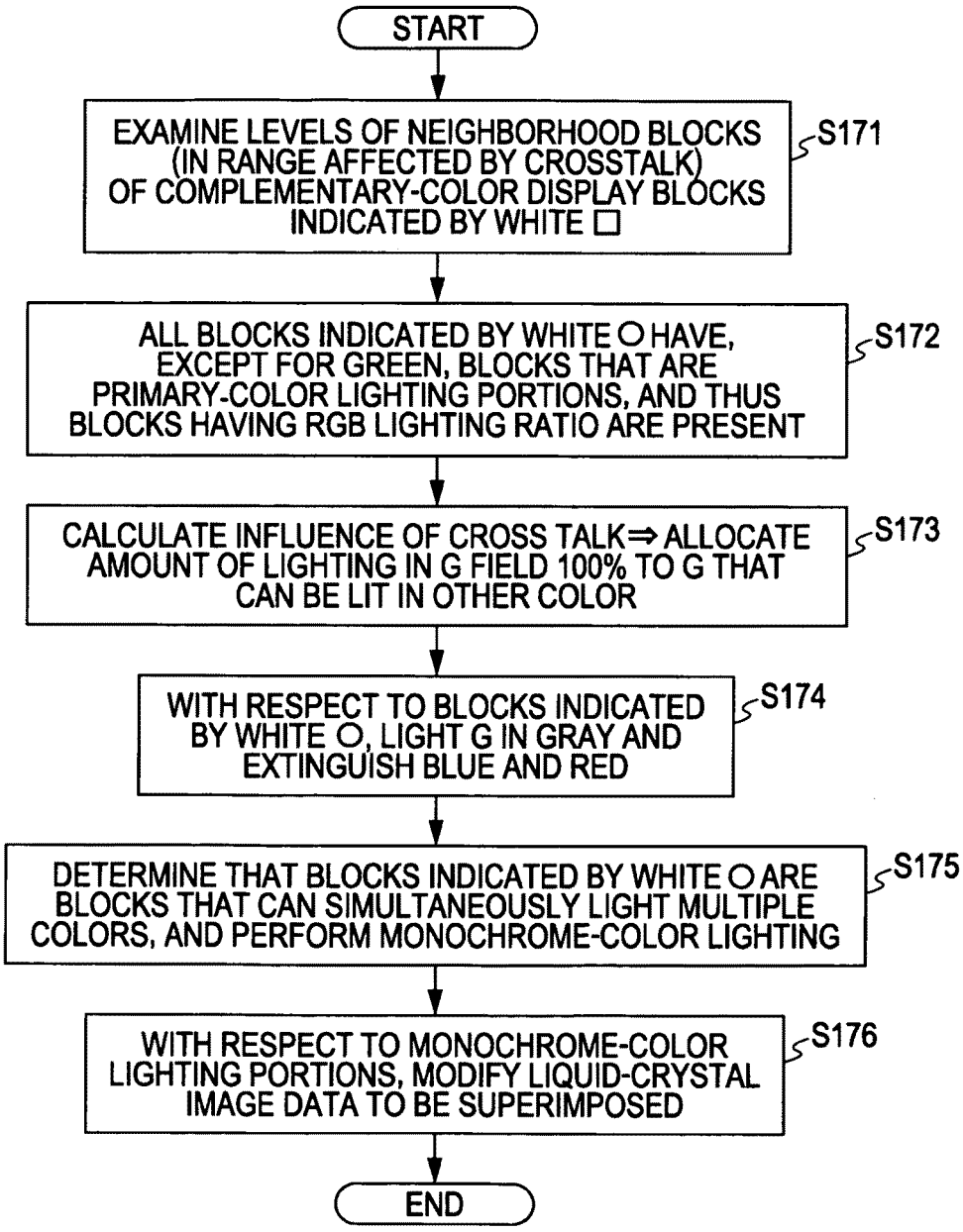
FIG. 28 is a flowchart showing a processing procedure for one example of the spatiotemporal processing for white.

One specific example of the processing in step S17, i.e., one example of the white spatiotemporal processing, will now be described with reference to the diagram shown in FIG. 27 and the flowchart shown in FIG. 28. In the diagram shown in FIG. 27, for simplicity of illustration, the backlight is divided into 3×4 blocks.

First, in step S171, the amounts of lighting of neighborhood blocks of complementary-color display blocks (indicated by white □) are examined. The "neighborhood blocks" herein refer to blocks located in a range affected by crosstalk. Next, in step S172, it is determined that all blocks indicated by white ○ have, except for green, primary-color lighting portions in their neighborhood. That is, it is determined that blocks having an RGB lighting ratio are present.

Next, in step S173, an influence of crosstalk is computed. As a result, the amount of lighting in the green field is allocated 100% to G that can be lit in other color. Next, in step S174, with respect to the blocks indicated by white ○, the green is lit in gray and blue and red are extinguished. Next, in step S175, it is determined that the blocks indicated by white ○ are blocks that can simultaneously light multiple colors, and monochrome color lighting is performed. In step S176, with respect to the monochrome-color lighting portions, liquid-crystal image data to be superimposed is also modified.

<Spatiotemporal Processing of Complementary Color>

Figure 29:
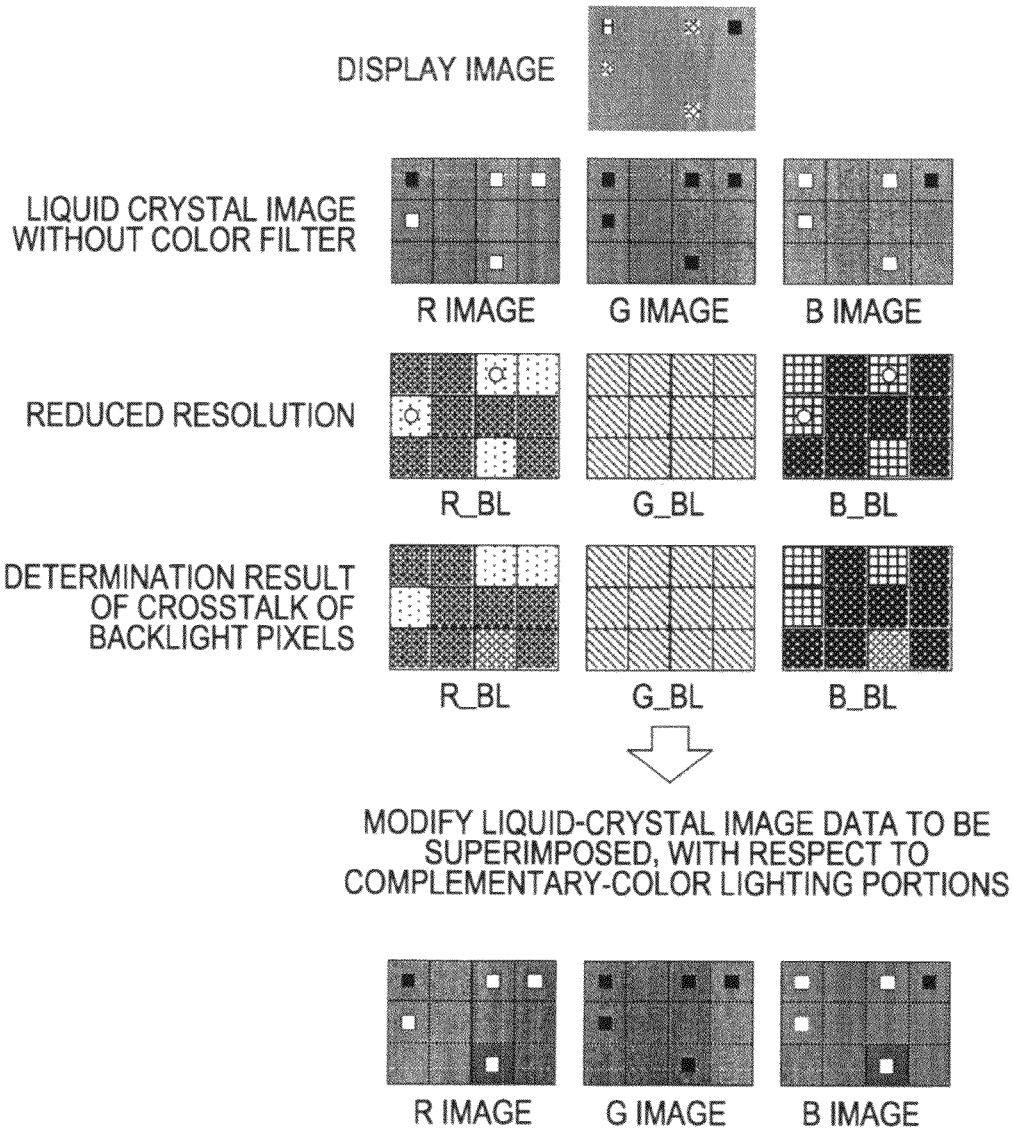
FIG. 29 illustrates one example of spatiotemporal processing for a complementary color.
Figure 30:
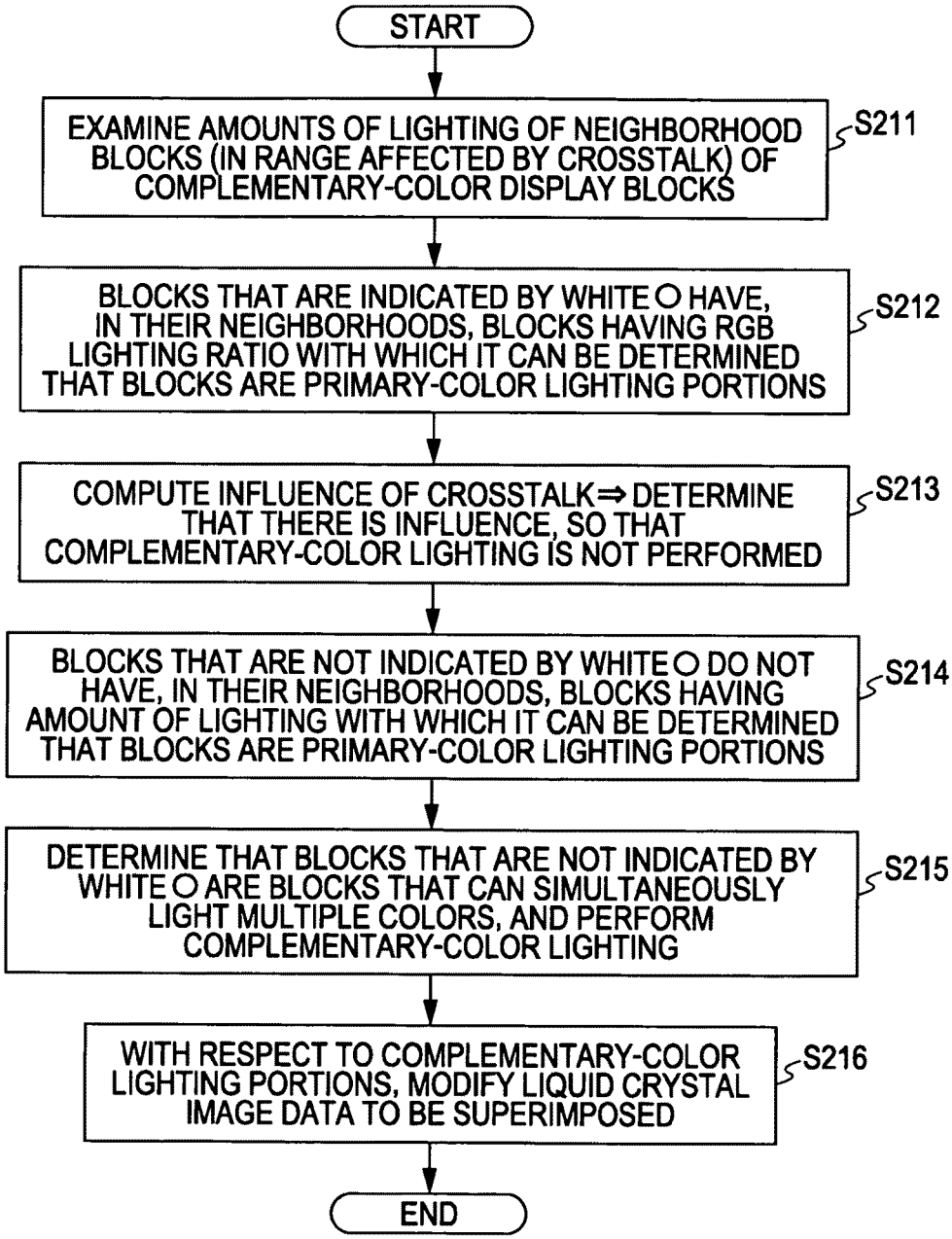
FIG. 30 is a flowchart showing a processing procedure for one example of the spatiotemporal processing for a complementary color.

One specific example of the processing in step S21, i.e., one example of the spatiotemporal processing for complementary colors, will now be described with reference to the diagram shown in FIG. 29 and the flowchart shown in FIG. 30. In the diagram shown in FIG. 29, the backlight is also divided into 3×4 blocks.

First, in step S211, the amounts of lighting of neighborhood blocks (in a range affected by crosstalk) of complementary-color display blocks are examined. Next, in step S212, it is determined that the blocks that are indicated by white ○ have, in their neighborhoods, blocks having the RGB lighting ratio with which it can be determined that the blocks are primary-color lighting portions. Next, in step S213, an influence of crosstalk is computed and it is determined that there is an influence. At this point, complementary-color lighting is not performed.

Next, in step S214, it is determined that the blocks that are not indicated by white ○ do not have, in their neighborhoods, blocks having the amount of lighting with which the neighborhood blocks can be determined as primary-color lighting portions. In step S215, it is determined that the blocks that are not indicated by white ○ are blocks that can simultaneously light multiple colors, and complementary-color lighting is performed. In step S216, with respect to the complementary-color lighting portions, liquid crystal image data to be superimposed is also modified.

[Effect of Present Embodiment]

As described above, rather than representing all colors with a mixture of RGB, all colors are separated into the three elements "reference white components", "complementary-color components", and "primary-color components" and the white components or the complementary-color components are, in principle, equally allocated, i.e., are allocated, in the field direction. More specifically, the present embodiment employs a scheme in which white components or complementary-color components are extracted from a color defined by an RGB ratio (an RGB constituent ratio or RGB mixture ratio) and the extracted white components or complementary color components are equally allocated to the fields.

With this scheme, color mixing is performed in space and combination of the amounts of illumination (the amounts of lighting) is performed over time. Thus, the inter-field correlations of the fields are increased compared to those in cases in which this scheme is not employed. An increase in the inter-field correlation can prevent occurrence of color breakup in the field sequential system. As the inter-field correlation increases using the scheme, it is possible to more reliably prevent occurrence of color breakup. As a result, even with a field-sequential display configuration without a color filter, it is possible to achieve color display with almost no color breakup.

In particular, the light-emitting area of the light source section 30, which serves as a backlight, is divided into the partial light-emitting areas 32, and the partial light-emitting areas 32 are partially driven independently of each other. This arrangement can partially add white components to the fields and thus can maintain color purities on the screen. As a result, it is possible to both prevent color breakup and maintain color purity on the screen. In the related art, on the other hand, since white components are not partially added, the color purity decreases. It is thus extremely difficult to both prevent color breakup and maintain color purity on the screen.

Figure 31:
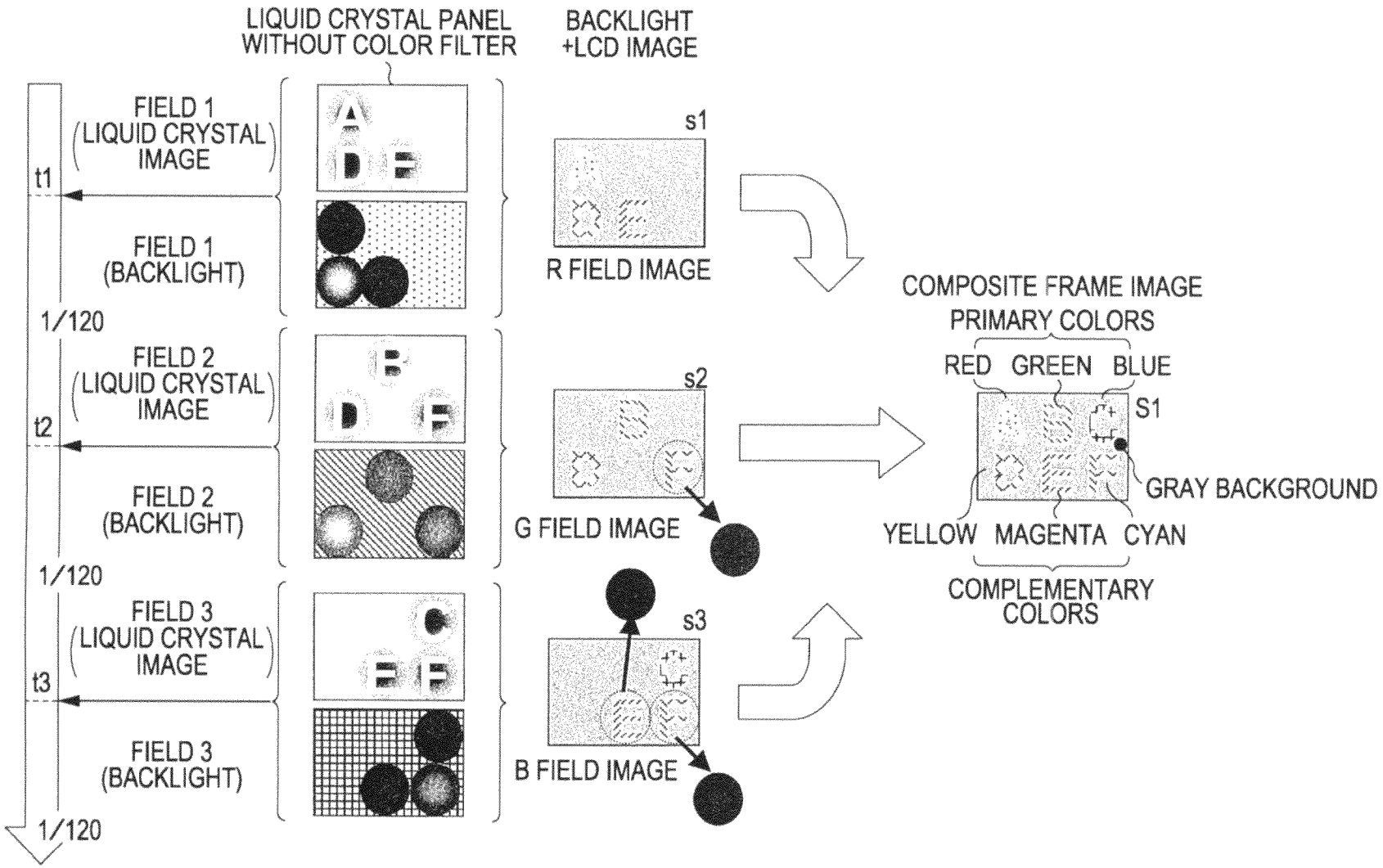
FIG. 31 illustrates an effect of distributing the amount of complementary color to fields.

Effects of the embodiment will now be described in conjunction with a specific example. An example in which the amount of complementary color to be displayed is allocated to fields will now be described with reference to FIG. 31. In this example, letter "A" is displayed in red, letter "B" is displayed in green, letter "C" is displayed in blue, letter "D" is displayed in yellow, letter "E" is displayed in magenta, and letter "F" is displayed in cyan to provide a composite frame image S1.

At time t1, for example, letters "A", "D", and "E" are displayed in monochrome color on the liquid crystal panel 20, and the red LEDs 31R in the light source section 30 are lit and controlled. At this point, the light source section 30 is partially driven so that illumination color of portions corresponding to the letter "D" becomes yellow light and illumination color of portions corresponding to the letter "E" becomes magenta light. Consequently, an R field screen s1 is displayed in a time division manner with the letter "A" being red, the letter "D" being yellow, and the letter "E" being magenta.

At time t2, for example, letters "B", "D", and "F" are displayed in monochrome color on the liquid crystal panel 20, and the green LEDs 31G in the light source section 30 are lit and driven. At this point, the light source section 30 is partially driven so that illumination color of portions corresponding to the letter "D" becomes yellow light and illumination color of portions corresponding to the letter "F" becomes cyan light. Consequently, a G field screen s2 is displayed in a time division manner with the letter "B" being green, the letter "D" being yellow, and the letter "F" being cyan.

At time t3, letters "C", "E", and "F" are displayed in monochrome color on the liquid crystal panel 20, and the blue LEDs 31B in the light source section 30 are lit and driven. At this point, the light source section 30 is partially driven so that illumination color of portions corresponding to the letter "E" becomes magenta light and illumination color of portions corresponding to the letter "F" becomes cyan light. Consequently, a G field screen s3 is displayed in a time division manner with the letter "C" being blue, the letter "E" being magenta, and the letter "F" being cyan.

The R, G, and B field screens s1, s2, and s3 are superimposed on each other as integration of the fields in the time axial direction, that is, are temporally integrated together on the human retina, and are thus seen by the human eye as one composite frame image S1. Since the letters "A", "B", and "C" in the composite frame image S1 are the R, G, and B primary colors, no color breakup occurs. Although the letters "D", "E", and "F" are the complementary colors, no color breakup occurs since the complementary color mixing is performed in the space. However, with respect to the gray background, color breakup occurs because of the RGB time sequence.

Figure 32:
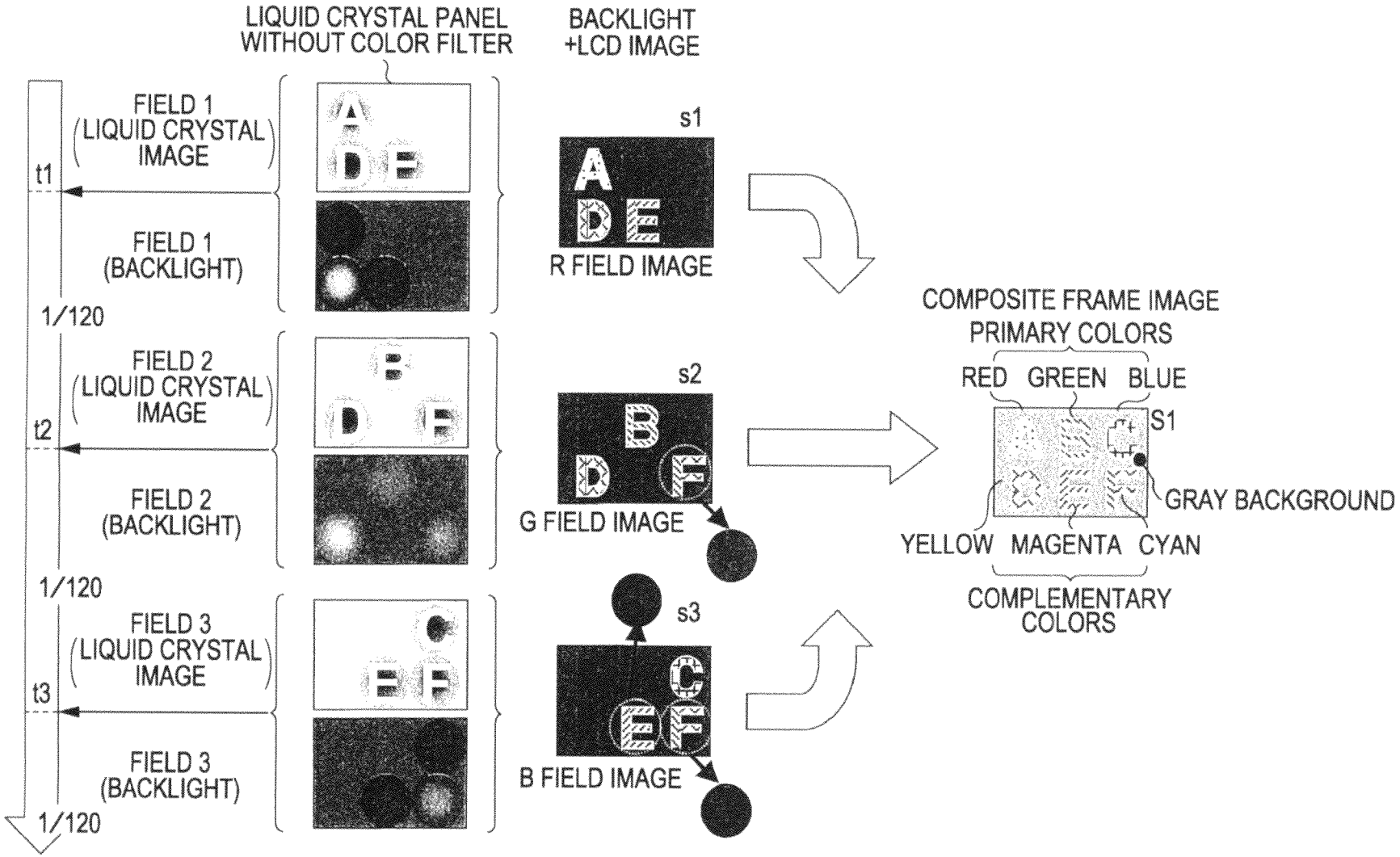
FIG. 32 illustrates an effect of distributing the amount of white to fields.

Now, a case in which the amount of white to be displayed is allocated to the fields will now be described with reference to FIG. 32. In this case, letter "A" is displayed in red, letter "B" is displayed in green, letter "C" is displayed in blue, letter "D" is displayed in yellow, letter "E" is displayed in magenta, and letter "F" is displayed in cyan to thereby provide a composite frame image S1.

At time t1, for example, letters "A", "D", and "E" are displayed in monochrome color on the liquid crystal panel 20, and gray is displayed on the light source section 30. At this point, the light source section 30 is partially driven so that illumination color of portions corresponding to the letter "A" becomes red light, illumination color of portions corresponding to the letter "D" becomes yellow light, and illumination color of portions corresponding to the letter "E" becomes magenta light. Consequently, an R field screen s1 is displayed in a time division manner with the letter "A" being red, the letter "D" being yellow, and the letter "E" being magenta.

At time t2, for example, letters "B", "D", and "F" are displayed in monochrome color on the liquid crystal panel 20, and gray is displayed on the light source section 30. At this point, the light source section 30 is partially driven so that illumination color of portions corresponding to the letter "B" becomes green light, illumination color of portions corresponding to the letter "D" becomes yellow light, and illumination color of portions corresponding to the letter "F" becomes cyan light. Consequently, a G field screen s2 is displayed in a time division manner with the letter "B" being green, the letter "D" being yellow, and the letter "F" being cyan.

At time t3, for example, letters "C", "E", and "F" are displayed in monochrome color on the liquid crystal panel 20, and gray is displayed on the light source section 30. At this point, the light source section 30 is partially driven so that illumination color of portions corresponding to the letter "C" becomes blue light, illumination color of portions corresponding to the letter "E" becomes magenta light, and illumination color of portions corresponding to the letter "F" becomes cyan light. Consequently, a B field screen s3 is displayed in a time division manner with the letter "C" being blue, the letter "E" being magenta, and the letter "F" being cyan.

The R, G, and B field screens s1, s2, and s3 are superimposed on each other as integration of the fields in the time axial direction, that is, are temporally integrated together on the human retina, and are thus seen by the human eye as one composite frame image S1. Since the letters "A", "B", and "C" in the composite frame image S1 are the R, G, and B primary colors, no color breakup occurs. Although the letters "D", "E", and "F" are the complementary colors, no color breakup occurs since the complementary color mixing is performed in the space. Since the gray background is also monochrome color, no color breakup occurs.

[Modification]

Although an example in which the present invention is applied to a liquid-crystal-display device that uses liquid crystal elements as modulation elements that modulate light of a light source to display images has been described above, the present invention is not limited thereto. For example, the present invention is also applicable to a variety of display devices that display images by utilizing and modulating light of a light source.

[Example of Application]

The above-described display device according to the embodiment or modification of the present invention can also be applied to display devices for electronic equipment in various fields in which video signals input to the electronic equipment or video signals generated by the electronic equipment are displayed as images or video. The above-described display device can also be applied to, for example, display devices for various types of electronic equipment (including those shown in FIGS. 33 and 34), such as television sets and notebook computers.

The use of the display device according to the embodiment or modification of the present invention as display devices for electronic equipment in various fields makes it possible to display high-quality images on the electronic equipment. That is, as is apparent from the above-described embodiment, the display device according to the embodiment of the present invention can achieve color display with almost no color breakup phenomenon, even with a field-sequential configuration without a color filter, and thus can provide a high-quality display images.

The display device according to the embodiment of the present invention may also take a modular form with a hermetically sealed configuration. One example is a display module having a configuration in which opposing sections, made of transparent glass or the like, are laminated together so as to surround a pixel array section. The display module may also have, for example, an FPC (flexible printed circuit) and a circuit section for externally inputting/outputting signals and so on to the pixel array section.

Specific examples of electronic equipment according to an embodiment of the present invention will be described below.

Figure 33:
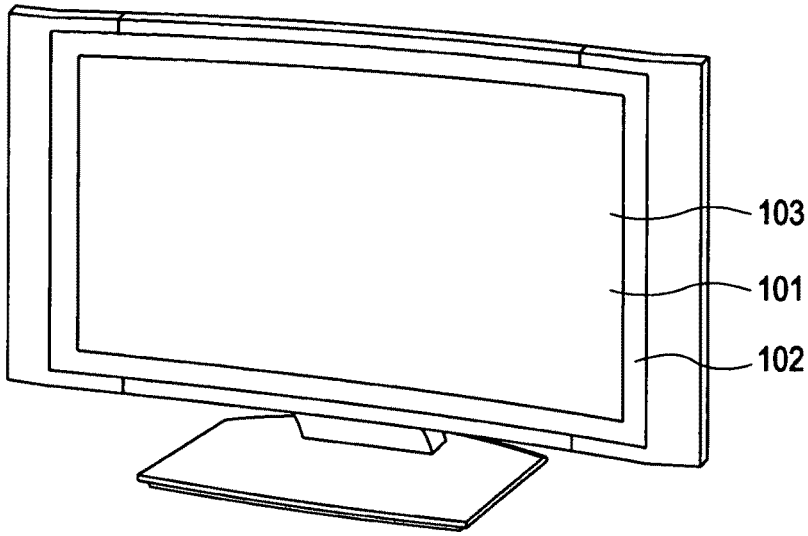
FIG. 33 is a perspective view showing an external appearance of a television set according to an embodiment of the present invention.

FIG. 33 is a perspective view showing an external appearance of a television set according to an embodiment of the present invention. The television set according to this embodiment has a video display screen section 101 that includes a front panel 102, a filter glass 103, and so on. The above-described display device according to the embodiment of the present invention is advantageously applicable to the video display screen section 101.

Figure 34:
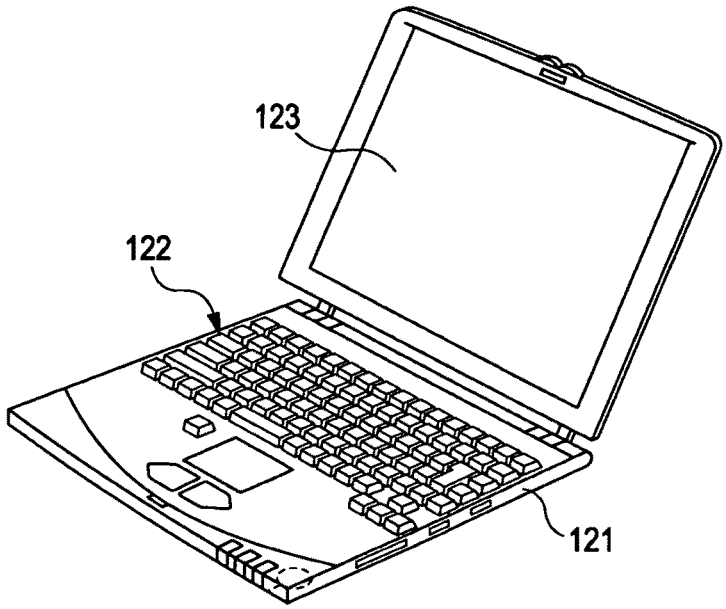
FIG. 34 is a perspective view showing an external appearance of a notebook computer according to an embodiment of the present invention.

FIG. 34 is a perspective view showing an external appearance of a notebook computer according to an embodiment of the present invention. The notebook computer according to this embodiment of the present invention has a main unit 121 that has, for example, a keyboard 122 operated for input of letters and so on and a display section 123 for displaying images. The above-described display device according to the embodiment of the present invention is advantageously applicable to the display section 123.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a light source section having multiple light sources arranged in a plane to emit, through independent light emission of the light sources, light in a number of illumination colors including three primary colors of light, the illumination colors being other than an achromatic color;

a display section configured to display an image in monochrome color by modulating the light emitted from the light source section; and a display control section configured to drive the light source section and the display section in a field sequential system in which the illumination colors of the light sources are switched for respective fields in one frame to perform color display, wherein a number of the fields in the one frame is same as the number of illumination colors;

wherein the display control section includes determining means for determining a degree of white and a degree of complementary color of the light sources on a basis of an amount of lighting of each of the illumination colors of the light sources, the amount of lighting being determined in accordance with a signal of a color image to be displayed, setting means for setting white components and complementary-color components of a color determined by a mixing ratio of the illumination colors, on a basis of a result of the determination performed by the determining means, and allocating means for allocating the white components and the complementary-color components, set by the setting means, by equally dividing the white components and the complementary-color components, respectively, into a plurality of amounts and equally allocating and distributing the plurality of amounts, respectively, of the white components and the complementary-color components to a plurality of the fields in the one frame corresponding respectively to the illumination colors.

2. A display device according to claim 1, wherein the determining means determines the degree of white and the degree of complementary color of the light sources on a basis of reference white color and reference complementary color, respectively, based on the illumination color having a lowest one of the amounts of lighting of the illumination colors.

3. The display device according to claim 1, wherein the light source section has a light-emitting area in which the light sources are arranged, the light-emitting area being divided into partial light-emitting areas, and the display control section partially drives the light source section, for each partial light-emitting area, to allocate the white components or the complementary-color components to the fields.

4. The display device according to claim 3, wherein, with respect to the partial light-emitting area in which all of the illumination colors are lit, the display control section allocates a reference white color to the fields.

5. The display device according to claim 3, wherein the display control section uses, as a reference complementary color, a complementary color obtained by extinguishing a predetermined one color that becomes a complementary color, on a basis of a ratio of the illumination colors that constitute a reference white color.

6. The display device according to claim 3, wherein, with respect to the partial light-emitting area at which a display image has a primary color, the display control section sets a field in which the primary color is to be mainly displayed and causes light of the primary color to be lit in the set field.

7. The display device according to claim 6, wherein the display control section allocates the amount of lighting of the primary color to the fields, when the amount of lighting of the primary color of the partial light-emitting area located in a neighborhood of the partial light-emitting area to be controlled is smaller than a predetermined value and the amount of lighting of another primary color is smaller than a predetermined value.

8. A drive method for a display device that has a light source section having multiple light sources arranged in a plane to emit, through independent light emission of the light sources, light in a number of illumination colors including three primary colors of light, the illumination colors being other than an achromatic color, and a display section configured to display an image in monochrome color by modulating the light emitted from the light source section, wherein during driving of the display device in a field sequential system in which the illumination colors of the light sources are switched for respective fields in one frame to perform color display, wherein a number of the fields in the one frame is same as the number of illumination colors, the drive method comprising the steps of:

determining a degree of white and a degree of complementary color of the light sources on a basis of an amount of lighting of each of the illumination colors of the light sources, the amount of lighting being determined in accordance with a signal of a color image to be displayed;

setting white components and complementary-color components of a color determined by a mixing ratio of the illumination colors, on a basis of a result of the determination performed in the determining step; and allocating the set white components and the complementary-color components, by equally dividing the white components and the complementary-color components, respectively, into a plurality of amounts and equally allocating and distributing the plurality of amounts, respectively, of the white components and the complementary-color components to a plurality of the fields in the one frame corresponding respectively to the illumination colors.

9. An electronic apparatus comprising a display device having:

a light source section having multiple light sources arranged in a plane to emit, through independent light emission of the light sources, light in a number of illumination colors including three primary colors of light, the illumination colors being other than an achromatic color;

a display section configured to display an image in monochrome color by modulating the light emitted from the light source section; and a display control section configured to drive the light source section and the display section in a field sequential system in which the illumination colors of the light sources are switched for respective fields in one frame to perform color display, wherein a number of the fields in the one frame is same as the number of illumination colors;

where the display control section includes determining means for determining a degree of white and a degree of complementary color of the light sources on a basis of an amount of lighting of each of the illumination colors of the light sources, the amount of lighting being determined in accordance with a signal of a color image to be displayed, setting means for setting white components and complementary-color components of a color determined by a mixing ratio of the illumination colors, on a basis of a result of the determination performed by the determining means, and allocating means for allocating, to each of the fields in the one frame corresponding respectively to the illumination colors, the white components and the complementary-color components, set by the setting means, by equally dividing the white components and the complementary-color components, respectively, into a plurality of amounts and equally allocating and distributing the plurality of amounts, respectively, of the white components and the complementary-color components to a plurality of the fields in the one frame corresponding respectively to the illumination colors.

10. A display device comprising:

a light source section having multiple light sources arranged in a plane to emit, through independent light emission of the light sources, light in a number of illumination colors including three primary colors of light, the illumination colors being other than an achromatic color;

a display section configured to display an image in monochrome color by modulating the light emitted from the light source section; and a display control section configured to drive the light source section and the display section in a field sequential system in which the illumination colors of the light sources are switched for respective fields in one frame to perform color display, wherein a number of the fields in the one frame is same as the number of illumination colors;

wherein the display control section includes a determining section configured to determine a degree of white and a degree of complementary color of the light sources on a basis of an amount of lighting of each of the illumination colors of the light sources, the amount of lighting being determined in accordance with a signal of a color image to be displayed, a setting section configured to set white components and complementary-color components of a color determined by a mixing ratio of the illumination colors, on a basis of a result of the determination performed by the determining section, and an allocating section configured to allocate the white components and the complementary-color components, set by the setting section, by equally dividing the white components and the complementary-color components, respectively, into a plurality of amounts and equally allocating and distributing the plurality of amounts, respectively, of the white components and the complementary-color components to a plurality of the fields in the one frame corresponding respectively to the illumination colors.

11. A display device according to claim 10, wherein the determining section determines the degree of white and the degree of complementary color of the light sources on a basis of reference white color and reference complementary color, respectively, based on the illumination color having a lowest one of the amounts of lighting of the illumination colors.

12. The display device according to claim 10, wherein the light source section has a light-emitting area in which the light sources are arranged, the light-emitting area being divided into partial light-emitting areas, and the display control section partially drives the light source section, for each partial light-emitting area, to allocate the white components or the complementary-color components to the fields.

13. The display device according to claim 12, wherein, with respect to the partial light-emitting area in which all of the illumination colors are lit, the display control section allocates a reference white color to the fields.

14. The display device according to claim 12, wherein the display control section uses, as a reference complementary color, a complementary color obtained by extinguishing a predetermined one color that becomes a complementary color, on a basis of a ratio of the illumination colors that constitute a reference white color.

15. The display device according to claim 12, wherein, with respect to the partial light-emitting area at which a display image has a primary color, the display control section sets a field in which the primary color is to be mainly displayed and causes light of the primary color to be lit in the set field.

16. The display device according to claim 15, wherein the display control section allocates the amount of lighting of the primary color to the fields, when the amount of lighting of the primary color of the partial light-emitting area located in a neighborhood of the partial light-emitting area to be controlled is smaller than a predetermined value and the amount of lighting of another primary color is smaller than a predetermined value.

17. An electronic apparatus comprising a display device having:

a light source section having multiple light sources arranged in a plane to emit, through independent light emission of the light sources, light in a number of illumination colors including three primary colors of light, the illumination colors being other than an achromatic color;

a display section configured to display an image in monochrome color by modulating the light emitted from the light source section; and a display control section configured to drive the light source section and the display section in a field sequential system in which the illumination colors of the light sources are switched for respective fields in one frame to perform color display, wherein a number of the fields in the one frame is same as the number of illumination colors;

where the display control section includes a determining section configured to determine a degree of white and a degree of complementary color of the light sources on a basis of an amount of lighting of each of the illumination colors of the light sources, the amount of lighting being determined in accordance with a signal of a color image to be displayed, a setting section configured to set white components and complementary-color components of a color determined by a mixing ratio of the illumination colors, on a basis of a result of the determination performed by the determining section, and an allocating section configured to allocate the white components and the complementary-color components, set by the setting section, by equally dividing the white components and the complementary-color components, respectively, into a plurality of amounts and equally allocating and distributing the plurality of amounts, respectively, of the white components and the complementary-color components to a plurality of the fields in the one frame corresponding respectively to the illumination colors.

* * * * *